US010495997B2

(12) United States Patent
Tsuchihashi

(10) Patent No.: US 10,495,997 B2
(45) Date of Patent: Dec. 3, 2019

(54) TONER

(71) Applicant: KYOCERA Document Solutions Inc., Osaka (JP)

(72) Inventor: Kazuki Tsuchihashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/390,470

(22) Filed: Apr. 22, 2019

(65) Prior Publication Data

US 2019/0332025 A1 Oct. 31, 2019

(30) Foreign Application Priority Data

Apr. 25, 2018 (JP) ..... 2018-083870

(51) Int. Cl.
*G03G 9/093* (2006.01)

(52) U.S. Cl.
CPC ..... *G03G 9/09321* (2013.01); *G03G 9/09328* (2013.01); *G03G 9/09371* (2013.01)

(58) Field of Classification Search
CPC ..... G03G 9/09321; G03G 9/09371; G03G 9/09328
USPC ..... 430/110.2
See application file for complete search history.

(56) References Cited

U.S. PATENT DOCUMENTS 9,804,517 B2 * 10/2017 Tsuchihashi ..... G03G 9/0819
2005/0271964 A1 12/2005 Etou et al.

FOREIGN PATENT DOCUMENTS

JP 2004-294469 A 10/2004

* cited by examiner

*Primary Examiner* — Janis L Dote
(74) *Attorney, Agent, or Firm* — Studebaker & Brackett PC

(57) ABSTRACT

A toner includes toner particles. The toner particles each include a toner core containing a binder resin, a first shell layer covering a surface of the toner core, and a second shell layer partially covering a surface of the first shell layer. The first shell layers include first domains composed of a first thermoplastic resin and second domains composed of a second thermoplastic resin. The first thermoplastic resin has a glass transition point of at least 35° C. and no greater than 66° C. The second thermoplastic resin has a glass transition point of at least 71° C. and no greater than 105° C. The second shell layers contain a third thermoplastic resin that is more hydrophobic than the first thermoplastic resin and the second thermoplastic resin. The third thermoplastic resin has a higher glass transition point than the first thermoplastic resin.

6 Claims, 2 Drawing Sheets

TONER

INCORPORATION BY REFERENCE

The present application claims priority under 35 U.S.C. § 119 to Japanese Patent Application No. 2018-083870, filed on Apr. 25, 2018. The contents of this application are incorporated herein by reference in their entirety.

BACKGROUND

The present disclosure relates to a toner.

A known toner includes toner particles each including a toner core and a shell layer covering a surface of the toner core. The toner can exhibit excellent heat-resistant preservability through the shell layers covering the toner cores.

SUMMARY

A toner according to an aspect of the present disclosure includes toner particles. The toner particles each include a toner core containing a binder resin, a first shell layer covering a surface of the toner core, and a second shell layer partially covering a surface of the first shell layer. The first shell layers include first domains composed of a first thermoplastic resin and second domains composed of a second thermoplastic resin. The first thermoplastic resin has a glass transition point of at least 35° C. and no greater than 66° C. The second thermoplastic resin has a glass transition point of at least 71° C. and no greater than 105° C. The second shell layers contain a third thermoplastic resin that is more hydrophobic than the first thermoplastic resin and the second thermoplastic resin. The third thermoplastic resin has a higher glass transition point than the first thermoplastic resin.

DETAILED DESCRIPTION

Figure 1:
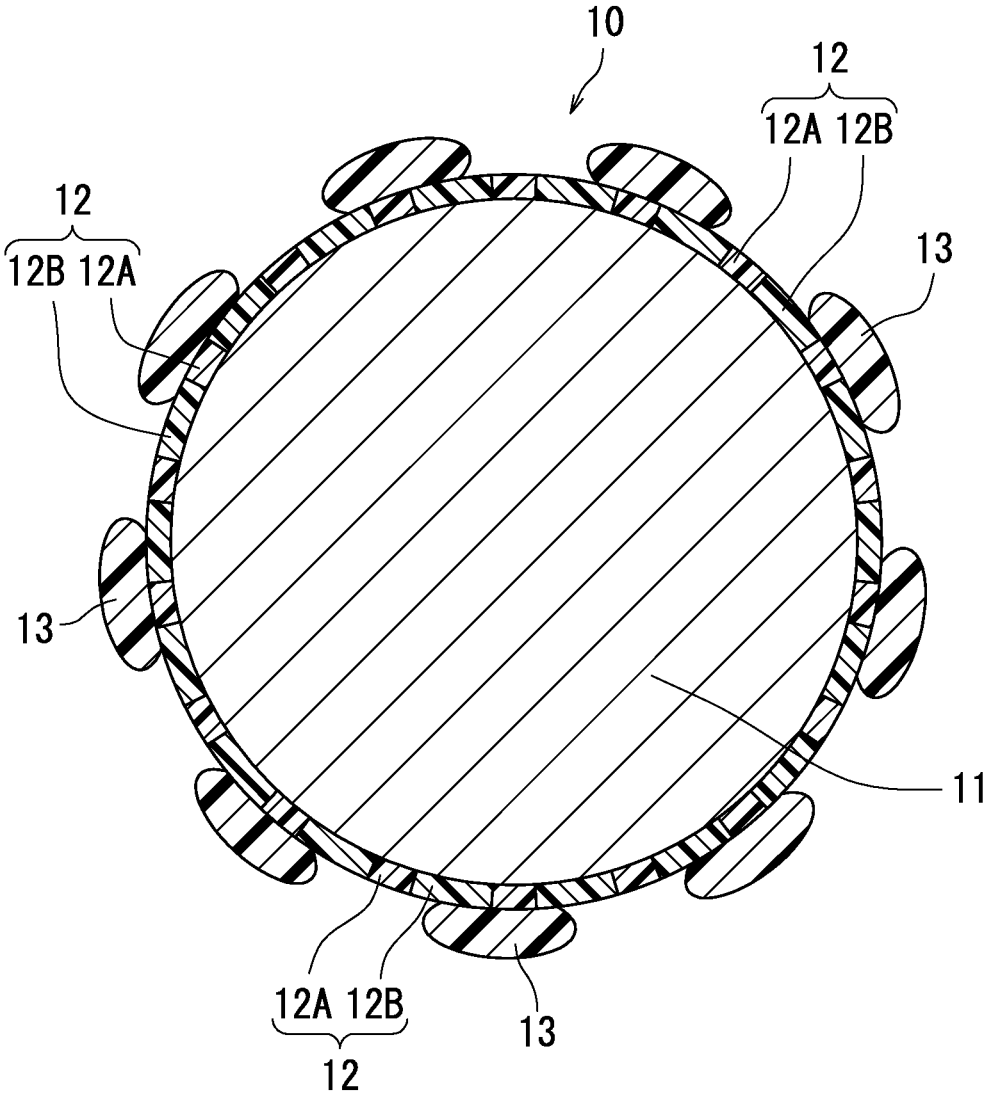
FIG. 1 is a diagram illustrating an example of a cross-sectional structure of a toner particle included in a toner according to an embodiment of the present disclosure.

The following describes a preferred embodiment of the present disclosure. A toner is a collection (for example, a powder) of toner particles. An external additive is a collection (for example, a powder) of external additive particles. Unless otherwise stated, evaluation results (for example, values indicating shape and physical properties) for a powder (specific examples include a powder of toner particles) are each a number average of values measured for a suitable number of particles selected from the powder.

A value for volume median diameter ($D_{50}$) of a powder is measured using a laser diffraction/scattering particle size distribution analyzer ("LA-950", product of Horiba, Ltd.), unless otherwise stated. A number average primary particle diameter of a powder is a number average of equivalent circle diameters of primary particles (Heywood diameter: diameters of circles having the same areas as projected areas of the primary particles) measured using a scanning electron microscope ("JSM-7401F", product of JEOL Ltd.), unless otherwise stated. A number average primary particle diameter of a powder is for example a number average of equivalent circle diameters of 100 primary particles of the powder. Note that a number average primary particle diameter of a powder refers to a number average primary particle diameter of particles in the powder (number average primary particle diameter of the powder), unless otherwise stated.

Chargeability refers to chargeability in triboelectric charging, unless otherwise stated. Strength of positive chargeability (or strength of negative chargeability) in triboelectric charging can be confirmed from a known triboelectric series or the like. A measurement target (for example, a toner) is triboelectrically charged for example by mixing and stirring the measurement target with a standard carrier (N-01: a standard carrier for a negatively chargeable toner, P-01: a standard carrier for a positively chargeable toner) provided by The Imaging Society of Japan. An amount of charge of the measurement target is measured before and after the triboelectric charging using for example a charge meter (Q/m meter). A measurement target having a larger change in amount of charge before and after the triboelectric charging has stronger chargeability.

A value for a softening point (Tm) is measured using a capillary rheometer ("CFT-500D", product of Shimadzu Corporation), unless otherwise stated. On an S-shaped curve (horizontal axis: temperature, vertical axis: stroke) plotted using the capillary rheometer, the softening point (Tm) is a temperature corresponding to a stroke value of "(base line stroke value+maximum stroke value)/2". A value for a melting point (Mp) is a temperature of a peak indicating maximum heat absorption on a heat absorption curve (vertical axis: heat flow (DSC signal), horizontal axis: temperature) plotted using a differential scanning calorimeter ("DSC-6220", product of Seiko Instruments Inc.), unless otherwise stated. Such an endothermic peak results from melting of a crystalline region. A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) plotted using the differential scanning calorimeter, a temperature at a point of inflection caused due to glass transition (specifically, a temperature at an intersection point between an extrapolation of a base line and an extrapolation of an inclined portion of the curve) corresponds to the glass transition point (Tg).

An acid value is measured in accordance with "Japanese Industrial Standard (JIS) K0070-1992", unless otherwise stated.

Strength of hydrophobicity (or strength of hydrophilicity) can for example be indicated by a contact angle with respect to a water droplet (water wettability). A larger contact angle with respect to a water droplet indicates stronger hydrophobicity.

Hereinafter, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl. The term "(meth) acrylonitrile" is used as a generic term for both acrylonitrile and methacrylonitrile. An organic group "optionally substituted with a substituent" means that some or all of hydrogen atoms of the organic group may each be replaced with a substituent. An organic group "optionally substituted with a phenyl group" means that some or all of hydrogen atoms of the organic group may each be replaced with a phenyl group.

<Toner>

A toner according to the present embodiment can for example be favorably used as a positively chargeable toner in development of electrostatic latent images. The toner according to the present embodiment is a collection (for example, a powder) of toner particles (particles each having features described below). The toner may be used as a one-component developer. Alternatively, a two-component developer may be prepared by mixing the toner and a carrier using a mixer (for example, a ball mill).

The toner particles included in the toner according to the present embodiment each include a toner core containing a binder resin, a first shell layer covering a surface of the toner core, and a second shell layer partially covering a surface of the first shell layer. The first shell layers include first domains composed of a first thermoplastic resin and second domains composed of a second thermoplastic resin. The first thermoplastic resin has a glass transition point of at least 35° C. and no greater than 66° C. The second thermoplastic resin has a glass transition point of at least 71° C. and no greater than 105° C. The second shell layers contain a third thermoplastic resin (also referred to below as a hydrophobic resin) that is more hydrophobic than the first thermoplastic resin and the second thermoplastic resin. The third thermoplastic resin has a higher glass transition point than the first thermoplastic resin.

Having the above-described features, the toner according to the present embodiment is excellent in low-temperature fixability, heat-resistant preservability, and anti-fogging performance. The reason for the above is thought to be as follows.

The first shell layers of the toner particles included in the toner according to the present embodiment include the first domains composed of the first thermoplastic resin having a glass transition point of at least 35° C. and no greater than 66° C. (also referred to below as a low-Tg resin). Each of the second shell layers partially covers the surface of the corresponding first shell layer. When a toner image formed using the toner according to the present embodiment is fixed to a recording medium, elution of a toner core component out of the toner particles tends to occur easily because of melting or softening of the first domains (for example, first domains that are not covered with the second shell layers) in the first shell layers. The toner according to the present embodiment is therefore excellent in low-temperature fixability.

In the toner particles included in the toner according to the present embodiment, as described above, the first shell layers include the first domains composed of the first thermoplastic resin (the low-Tg resin) and each of the second shell layers partially covers the surface of the corresponding first shell layer. Thus, the toner according to the present embodiment can prevent contact of the first domains, which are composed of the low-Tg resin, with one another among the toner particles. The first shell layers of the toner particles included in the toner according to the present embodiment also include the second domains composed of the second thermoplastic resin having a glass transition point of at least 71° C. and no greater than 105° C. (also referred to below as a high-Tg resin). Furthermore, the second shell layers of the toner particles included in the toner according to the present embodiment contain the third thermoplastic resin having a higher glass transition point than the first thermoplastic resin (the low-Tg resin) forming the first domains in the first shell layers. The toner according to the present embodiment is therefore excellent in heat-resistant preservability even though a portion of each first shell layer is composed of the low-Tg resin.

Furthermore, the third thermoplastic resin contained in the second shell layers located outward of the first shell layers of the toner particles included in the toner according to the present embodiment is a hydrophobic resin. The toner according to the present embodiment is therefore excellent in anti-fogging performance, being able to inhibit charge decay of the toner particles due to moisture, for example.

Each first shell layer does not need to entirely cover the surface of the corresponding toner core. That is, the first shell layer does not need to cover 100% of a surface area of the toner core as long as the first shell layer covers the surface of the toner core to the extent that the binder resin can be prevented from bleeding out of the toner core (particularly, to the extent that a low-molecular component of the binder resin can be prevented from bleeding out of the toner core). Preferably, at least 90% and no greater than 100% of the surface area of the toner core is covered with the first shell layer (also referred to below as a first shell layer coverage ratio). More preferably, at least 95% and no greater than 100% of the surface area of the toner core is covered with the first shell layer. As a result of the first shell layer coverage ratio being at least 90%, the toner can have further improved heat-resistant preservability.

Preferably, at least 30% and no greater than 70% of the surface area of the first shell layer is covered with the corresponding second shell layer (also referred to below as a second shell layer coverage ratio). As a result of the second shell layer coverage ratio being at least 30%, the toner can have further improved heat-resistant preservability. As a result of the second shell layer coverage ratio being no greater than 70%, the toner can have further improved low-temperature fixability. In the toner having a first shell layer coverage ratio of less than 100%, a portion of the surface of each toner core is not covered with the first shell layer, and the second shell layer may cover such a portion.

The first shell layer coverage ratio and the second shell layer coverage ratio can be measured by analyzing transmission electron microscope (TEM) images of cross-sections of the toner particles using commercially available image analysis software (for example, "WinROOF", product of Mitani Corporation). For example, in a TEM image of a cross-section of a dyed toner particle, the first shell layer coverage ratio can be obtained by measuring a percentage of an area covered with the first shell layer out of the surface area of the toner core (an area defined by an outline representing a periphery of the toner core). For another example, in a TEM image of a cross-section of a dyed toner particle, the second shell layer coverage ratio can be obtained by measuring a percentage of an area covered with the second shell layer out of the surface area of the first shell layer (an area defined by an outline representing a periphery of the first shell layer).

The toner cores may further contain an internal additive (for example, at least one of a colorant, a releasing agent, a charge control agent, and a magnetic powder) as necessary in addition to the binder resin.

The toner particles included in the toner according to the present embodiment may include an external additive. In the case of the toner particles including an external additive, each toner particle includes the external additive and a toner mother particle having a toner core, a first shell layer, and a second shell layer. The external additive adheres to a surface of the toner mother particle. The external additive may be omitted if not required. In the toner including no external additive, the toner mother particles are equivalent to the toner particles.

The following describes the toner according to the present embodiment in detail with reference to the accompanying drawings as appropriate.

[Structure of Toner Particles]

The following describes a structure of the toner particles included in the toner according to the present embodiment with reference to FIG. 1. FIG. 1 is a diagram illustrating an example of a cross-sectional structure of a toner particle included in the toner according to the present embodiment. In order to facilitate explanation, a toner particle 10 illustrated in FIG. 1 will be described as a toner particle including no external additive. Some elements are shown exaggerated in scale in FIG. 1 to facilitate understanding.

The toner particle 10 illustrated in FIG. 1 includes a toner core 11 containing a binder resin, a first shell layer 12 covering a surface of the toner core 11, and a second shell layer 13 partially covering a surface of the first shell layer 12. The first shell layer 12 includes at least one first domain 12A composed of the first thermoplastic resin and at least one second domain 12B composed of the second thermoplastic resin. The first thermoplastic resin has a glass transition point of at least 35° C. and no greater than 66° C. The second thermoplastic resin has a glass transition point of at least 71° C. and no greater than 105° C. The second shell layer 13 contains the third thermoplastic resin that is more hydrophobic than the first thermoplastic resin and the second thermoplastic resin. The third thermoplastic resin has a higher glass transition point than the first thermoplastic resin.

In order to obtain a toner further improved in low-temperature fixability, preferably, at least a portion of the surface of the first domain 12A is not covered with the second shell layer 13 as illustrated in FIG. 1.

The first shell layer 12 for example has a sea-and-island structure including the at least one first domain 12A and the at least one second domain 12B. The first shell layer 12 having a sea-and-island structure may have first domains 12A distributed like islands and a second domain 12B spreading like a sea. Alternatively, the first shell layer 12 having a sea-and-island structure may have a first domain 12A spreading like a sea and second domains 12B distributed like islands.

In order to obtain a toner further improved in heat-resistant preservability, the first thermoplastic resin preferably has a glass transition point of at least 36° C. In order to obtain a toner further improved in low-temperature fixability, the second thermoplastic resin preferably has a glass transition point of no greater than 101° C.

In order to obtain a toner further improved in heat-resistant preservability, preferably, the glass transition point of the third thermoplastic resin is at least 10° C. higher than the glass transition point of the first thermoplastic resin. More preferably, the glass transition point of the third thermoplastic resin is at least 12° C. higher than the glass transition point of the first thermoplastic resin. In order to obtain a toner further improved in low-temperature fixability, preferably, the glass transition point of the third thermoplastic resin does not exceed a temperature 45° C. higher than the glass transition point of the first thermoplastic resin.

In order to obtain a toner further improved in heat-resistant preservability and low-temperature fixability, the glass transition point of the third thermoplastic resin is preferably at least 45° C. and no greater than 100° C., and more preferably at least 48° C. and no greater than 81° C.

The first shell layer 12 may further contain a component (for example, an additional resin) other than the first thermoplastic resin and the second thermoplastic resin. In order to obtain a toner further improved in heat-resistant preservability and low-temperature fixability, however, a sum of amounts of the first thermoplastic resin and the second thermoplastic resin is preferably at least 80% by mass of a total amount of all components of the first shell layer 12, more preferably at least 90% by mass, and particularly preferably 100% by mass.

The second shell layer 13 may further contain a component (for example, an additional resin) other than the third thermoplastic resin. In order to obtain a toner further improved in heat-resistant preservability and anti-fogging performance, however, an amount of the third thermoplastic resin is preferably at least 80% by mass of a total amount of all components of the second shell layer 13, more preferably at least 90% by mass, and particularly preferably 100% by mass.

In order to obtain a toner further improved in heat-resistant preservability and low-temperature fixability, the first shell layer 12 preferably has a thickness of at least 1 nm and no greater than 400 nm. The thickness of the first shell layer 12 can be measured by dying the toner particle 10 and analyzing a transmission electron microscope (TEM) image of a cross-section of the dyed toner particle 10 using commercially available image analysis software (for example, "WinROOF", product of Mitani Corporation). Note that if the thickness of the first shell layer 12 is not uniform for a single toner particle 10, the thickness of the first shell layer 12 is measured at each of four locations that are approximately evenly spaced and the arithmetic mean of the four measured values is determined to be an evaluation value (the thickness of the first shell layer 12) for the toner particle 10. Specifically, the four measurement locations are determined by drawing two straight lines that intersect at right angles at approximately the center of the cross-section of the toner particle 10 and determining four locations at which the two straight lines and the first shell layer 12 intersect to be the measurement locations.

In order to obtain a toner further improved in heat-resistant preservability and anti-fogging performance, the second shell layer 13 preferably has a thickness of at least 1 nm and no greater than 400 nm. The thickness of the second shell layer 13 is measured according to the above-described measurement method of the thickness of the first shell layer 12.

In order to obtain a toner suitable for image formation, the toner core 11 preferably has a volume median diameter ($D_{50}$) of at least 4 μm and no greater than 9 μm.

An example of the toner particle included in the toner according to the present embodiment has been described above with reference to FIG. 1. However, the present disclosure is not limited to the example. For example, the toner particles included in the toner according to the present disclosure may include an external additive (not shown). For example, toner particles included in the toner according to the present disclosure may each include the toner particle 10 illustrated in FIG. 1 as a toner mother particle and have an external additive adhering to a surface of the toner mother particle.

[Components of Toner Particles]

The following describes components of the toner particles included in the toner according to the present embodiment.

(Binder Resin)

In order to obtain a toner further improved in low-temperature fixability, the toner cores preferably contain a thermoplastic resin as a binder resin. More preferably, the thermoplastic resin contained in the toner cores accounts for at least 85% by mass of a total mass of the binder resin. Examples of thermoplastic resins that can be used include styrene-based resins, acrylic acid ester-based resins, olefin-based resins (specific examples include polyethylene resins and polypropylene resins), vinyl resins (specific examples include vinyl chloride resins, polyvinyl alcohol, vinyl ether resins, and N-vinyl resins), polyester resins, polyamide resins, and urethane resins. Furthermore, copolymers of the resins listed above, that is, copolymers obtained through incorporation of a repeating unit into any of the resins listed above (specific examples include styrene-acrylic acid ester-based resins and styrene-butadiene-based resins) may be used as the binder resin.

A thermoplastic resin can be obtained through addition polymerization, copolymerization, or polycondensation of at least one thermoplastic monomer. Note that the thermoplastic monomer means a monomer that forms a thermoplastic resin through homopolymerization (specific examples include acrylic acid ester-based monomers and styrene-based monomers) or a monomer that forms a thermoplastic resin through polycondensation (for example, a combination of a polyhydric alcohol and a polycarboxylic acid that form a polyester resin through polycondensation).

In order to obtain a toner further improved in low-temperature fixability, the toner cores preferably contain a polyester resin as the binder resin. In order that the polyester resin contained as the binder resin is highly reactive with an oxazoline group in a repeating unit (1-1) described below, the polyester resin preferably has an acid value of at least 2 mgKOH/g, and more preferably an acid value of at least 2 mgKOH/g and no greater than 25 mgKOH/g.

Preferably, the polyester resin is a resin mixture of a crystalline polyester resin and a non-crystalline polyester resin. As a result of the toner cores containing a crystalline polyester resin and a non-crystalline polyester resin as the binder resin, it is possible to obtain a toner further improved in low-temperature fixability while ensuring high dispersibility of the internal additive. In such a case, no particular limitations are placed on a mixing ratio between the crystalline polyester resin and the non-crystalline polyester resin. For example, at least 1 part by mass and no greater than 30 parts by mass of the crystalline polyester resin can be mixed relative to 100 parts by mass of the non-crystalline polyester resin.

In order that the toner is suitably sharp-melting, the toner cores preferably contain a crystalline polyester resin having a crystallinity index of at least 0.90 and no greater than 1.20 as the binder resin. The crystallinity index of the crystalline polyester resin can be adjusted by changing materials for synthesizing the crystalline polyester resin or amounts of use (blend ratio) of the materials. Note that the crystallinity index of a resin is equivalent to a ratio (Tm/Mp) of the softening point (Tm, unit: ° C.) of the resin to the melting point (Mp, unit: ° C.) of the resin. Mp of a non-crystalline polyester resin is often indeterminable. That is, a resin may be measured using a differential scanning calorimeter to result in a heat absorption curve on which an endothermic peak cannot be clearly determined. Such a resin can be determined to be a non-crystalline polyester resin.

A polyester resin is obtained through polycondensation of at least one polyhydric alcohol and at least one polycarboxylic acid. Examples of alcohols that can be used for synthesis of the polyester resin include dihydric alcohols (specific examples include aliphatic diols and bisphenols) and tri- or higher-hydric alcohols listed below. Examples of carboxylic acids that can be used for synthesis of the polyester resin include dibasic carboxylic acids and tri- or higher-basic carboxylic acids listed below. Note that a derivative of a polycarboxylic acid that can form an ester bond through polycondensation, such as a polycarboxylic acid anhydride or a polycarboxylic acid halide, may be used instead of a polycarboxylic acid.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- and higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

In a composition in which the binder resin contains a polyester resin, the binder resin may contain only the polyester resin, or the binder resin may contain the polyester resin and another resin. In a composition in which the binder resin contains a crystalline polyester resin and a non-crystalline polyester resin, the binder resin preferably further contains a styrene-acrylic acid-based resin. The styrene-acrylic acid-based resin is a copolymer of at least one styrene-based monomer and at least one acrylic acid-based monomer. As a result of the binder resin containing a styrene-acrylic acid-based resin, it is possible to obtain a toner having excellent charge stability.

Examples of styrene-based monomers that can be used for synthesis of the styrene-acrylic acid-based resin include styrene, o-methylstyrene, m-methylstyrene, p-methylstyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene.

Examples of acrylic acid-based monomers that can be used for synthesis of the styrene-acrylic acid-based resin include (meth)acrylic acid, methyl (meth)acrylate, ethyl (meth)acrylate, n-propyl (meth)acrylate, iso-propyl (meth) acrylate, n-butyl (meth)acrylate, isobutyl (meth)acrylate, t-butyl (meth)acrylate, n-octyl (meth)acrylate, 2-ethylhexyl (meth)acrylate, stearyl (meth)acrylate, lauryl (meth)acrylate, and phenyl (meth)acrylate.

(Colorant)

The toner cores may contain a colorant. The colorant can be a commonly known pigment or dye that matches the color of the toner. In order to form high-quality images using the toner, the colorant is preferably contained in an amount of at least 1 part by mass and no greater than 20 parts by mass relative to 100 parts by mass of the binder resin.

The toner cores may contain a black colorant. The black colorant is for example carbon black. A colorant that is adjusted to a black color using a yellow colorant, a magenta colorant, and a cyan colorant can be used as a black colorant.

The toner cores may contain a non-black colorant. The non-black colorant is for example a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant that can be used is for example at least one compound selected from the group consisting of copper phthalocyanine compounds, anthraquinone compounds, and basic dye lake compounds. Examples of cyan colorants that can be used include C. I. Pigment Blue (1, 7, 15, 15:1, 15:2, 15:3, 15:4, 60, 62, and 66), Phthalocyanine Blue, C. I. Vat Blue, and C. I. Acid Blue.

(Releasing Agent)

The toner cores may contain a releasing agent. The releasing agent is for example used to obtain a toner having excellent offset resistance. In order to obtain a toner having excellent offset resistance, the releasing agent is preferably contained in an amount of at least 1 part by mass and no greater than 20 parts by mass relative to 100 parts by mass of the binder resin.

Examples of releasing agents that can be used include ester waxes, polyolefin waxes (specific examples include polyethylene wax and polypropylene wax), microcrystalline wax, fluororesin wax, Fischer-Tropsch wax, paraffin wax, candelilla wax, montan wax, and castor wax. Examples of ester waxes that can be used include natural ester waxes (specific examples include carnauba wax and rice wax) and synthetic ester waxes. According to the present embodiment, one releasing agent may be used independently, or two or more releasing agents may be used in combination.

A compatibilizer may be added to the toner cores in order to improve compatibility between the binder resin and the releasing agent.

(Charge Control Agent)

The toner cores may contain a charge control agent. The charge control agent is for example used in order to improve charge stability and a charge rise characteristic of the toner. The charge rise characteristic of the toner is an indicator as to whether the toner can be charged to a specific charge level in a short period of time.

The cationic strength of the toner cores can be increased through the toner cores containing a positively chargeable charge control agent. The anionic strength of the toner cores can be increased through the toner cores containing a negatively chargeable charge control agent.

Examples of positively chargeable charge control agents that can be used include azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; alkoxylated amines; alkylamides; quaternary ammonium salts such as benzyldecylhexylmethyl ammonium chloride, decyltrimethyl ammonium chloride, 2-(methacryloyloxy)ethyltrimethylammonium chloride, and dimethylaminopropyl acrylamide methyl chloride quaternary salt; and quaternary ammonium cation group-containing resins. One of the charge control agents listed above may be used independently, or two or more of the charge control agents listed above may be used in combination.

Examples of negatively chargeable charge control agents that can be used include organic metal complexes, which are chelate compounds. Examples of preferable organic metal complexes include metal acetylacetonate complex, salicylic acid-based metal complex, and salts thereof.

In order to obtain a toner having excellent charge stability, the charge control agent is preferably contained in an amount of at least 0.1 parts by mass and no greater than 20 parts by mass relative to 100 parts by mass of the binder resin.

(Magnetic Powder)

The toner cores may contain a magnetic powder. Examples of materials of the magnetic powder that can be used include ferromagnetic metals (specific examples include iron, cobalt, and nickel) and alloys thereof, ferromagnetic metal oxides (specific examples include ferrite, magnetite, and chromium dioxide), and materials subjected to ferromagnetization (specific examples include carbon materials made ferromagnetic through thermal treatment). According to the present embodiment, one magnetic powder may be used independently, or two or more magnetic powders may be used in combination.

(First Shell Layer)

The first shell layers include first domains composed of the first thermoplastic resin having a glass transition point of at least 35° C. and no greater than 66° C. and second domains composed of the second thermoplastic resin having a glass transition point of at least 71° C. and no greater than 105° C. In order to obtain a toner further improved in heat-resistant preservability and low-temperature fixability, a mass ratio of the second domains to the first domains (second domains/first domains) is preferably at least 0.5 and no greater than 2.5.

In a composition in which the binder resin in the toner cores contains a polyester resin, preferably, the first thermoplastic resin and the second thermoplastic resin are each a polymer of one or more monomers including at least a compound represented by formula (1) shown below (also referred to below as a compound (1)) in order to uniformly form the first shell layers on the surfaces of the toner cores.

(1)

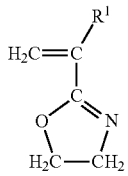

In formula (1), $R^1$ represents a hydrogen atom or an alkyl group optionally substituted with a phenyl group. Examples of alkyl groups that may be represented by $R^1$ include a methyl group, an ethyl group, and an isopropyl group. Examples of preferable $R^1$ include a hydrogen atom, a methyl group, an ethyl group, and an isopropyl group.

The polymer of one or more monomers including at least the compound (1) may be a copolymer obtained through copolymerization of the compound (1) with an additional vinyl compound. Tg of a resulting copolymer (a thermoplastic resin) can be adjusted by changing at least one of the type of the additional vinyl compound and the mole ratio of the additional vinyl compound to the compound (1) in the copolymerization. A vinyl compound refers to a compound having a vinyl group ($CH_2$=CH—) or a substituted vinyl group in which hydrogen is replaced (specific examples include ethylene, propylene, butadiene, vinyl chloride, (meth)acrylic acid, methyl (meth)acrylate, (meth)acrylonitrile, and styrene). The vinyl compound can be formed into a polymer (resin) by addition polymerization through carbon-to-carbon double bonds "C=C" in the vinyl group or the substituted vinyl group.

The additional vinyl compound is preferably at least one vinyl compound selected from the group consisting of alkyl acrylate-based monomers and styrene-based monomers.

Examples of alkyl acrylate-based monomers that can be used include a compound represented by formula (2) shown below (also referred to below as a compound (2)) and a compound represented by formula (3) shown below (also referred to below as a compound (3)).

(2)

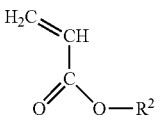

In formula (2), $R^2$ represents an alkyl group optionally substituted with a substituent. Examples of alkyl groups that may be represented by $R^2$ include a methyl group, an ethyl group, an n-propyl group, an isopropyl group, an n-butyl group, an isobutyl group, and a 2-ethylhexyl group. In a situation in which $R^2$ represents an alkyl group substituted with a substituent, the substituent is for example a hydroxy group. Examples of preferable $R^2$ include a methyl group, an ethyl group, an n-propyl group, an isopropyl group, an n-butyl group, an isobutyl group, a 2-ethylhexyl group, a hydroxyethyl group (for example, a 2-hydroxyethyl group), a hydroxypropyl group, and a hydroxybutyl group.

(3)

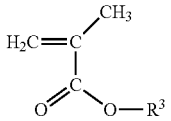

In formula (3), $R^3$ represents an alkyl group optionally substituted with a substituent. Examples of alkyl groups that may be represented by $R^3$ include a methyl group, an ethyl group, an n-propyl group, an isopropyl group, an n-butyl group, an isobutyl group, and a 2-ethylhexyl group. In a situation in which $R^3$ represents an alkyl group substituted with a substituent, the substituent is for example a hydroxy group. Examples of preferable $R^3$ include a methyl group, an ethyl group, an n-propyl group, an isopropyl group, an n-butyl group, an isobutyl group, a 2-ethylhexyl group, a hydroxyethyl group (for example, a 2-hydroxyethyl group), a hydroxypropyl group, and a hydroxybutyl group.

The compound (1) forms a repeating unit represented by formula (1-1) shown below (referred to below as a repeating unit (1-1)) through addition polymerization. $R^1$ in formula (1-1) shown below is the same as defined for $R^1$ in formula (1).

(1-1)

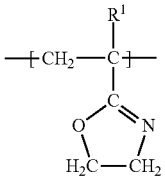

The repeating unit (1-1) has a non-ring-opened oxazoline group. The non-ring-opened oxazoline group has a ring structure and has strong positive chargeability. The non-ring-opened oxazoline group is reactive with a carboxy group, an aromatic sulfanyl group, and an aromatic hydroxy group. During first shell layer formation, for example, a reaction between the repeating unit (1-1) and a carboxy group in the polyester resin in the toner cores occurs to cause ring-opening of the oxazoline group, and thus an amide bond and an ester bond are formed as illustrated in formula (1-2) shown below. Formation of such bonds ensures strong bonding between the toner cores and the first shell layers, and inhibits detachment of the first shell layers from the toner cores. $R^1$ in formula (1-2) shown below is the same as defined for $R^1$ in formula (1). An asterisk in formula (1-2) shown below represents a site that is bonded to an atom in the polyester resin in the toner cores.

(1-2)

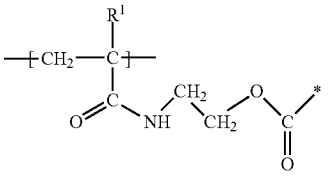

In order to inhibit detachment of the first shell layers from the toner cores while improving positive chargeability of the toner, preferably, the first thermoplastic resin and the second thermoplastic resin are each a vinyl resin including the repeating unit (1-1) and a repeating unit represented by formula (1-2) (referred to below as a repeating unit (1-2)). The vinyl resin including the repeating unit (1-1) and the repeating unit (1-2) is also referred to below as a specific vinyl resin. The strength of positive chargeability of the specific vinyl resin (that is, positive chargeability of the toner) tends to increase with an increase in a proportion (mole ratio) of the repeating unit (1-1) in the specific vinyl resin. The strength of bonding between the toner cores and the first shell layers tends to increase with an increase in a proportion (mole ratio) of the repeating unit (1-2) in the specific vinyl resin. In order to inhibit detachment of the first shell layers from the toner cores while improving positive chargeability of the toner, the first shell layers preferably contain the specific vinyl resin in an amount of at least 90% by mass relative to the total amount of the first shell layers, and more preferably in an amount of 100% by mass relative to the total amount of the first shell layers. The mole ratio between the repeating unit (1-1) and the repeating unit (1-2) in the specific vinyl resin can for example be adjusted by changing at least one of the acid value of the binder resin in the toner cores and an amount of a ring-opening agent (for example, an aqueous acetic acid solution) that is used for the first shell layer formation.

Formation of the repeating unit (1-2) through ring-opening of the oxazoline group during the first shell layer formation can for example be confirmed by a method described below. First, a specific amount of toner particles (a sample) are dissolved in a solvent. The resultant solution is placed in a test tube for nuclear magnetic resonance (NMR) measurement, and a $^{1}$H-NMR spectrum is measured using an NMR apparatus. In the $^{1}$H-NMR spectrum, a triplet signal derived from a secondary amide appears around a chemical shift δ of 6.5. The presence of a triplet signal around a chemical shift δ of 6.5 in the measured $^{1}$H-NMR spectrum therefore indicates formation of the repeating unit (1-2) through ring-opening of the oxazoline group during the first shell layer formation. Measurement conditions for the $^{1}$H-NMR spectrum are for example as follows.

(Example of Measurement Conditions for $^{1}$H-NMR Spectrum)

NMR apparatus: Fourier transform nuclear magnetic resonance (FT-NMR) apparatus ("JNM-AL400", product of JEOL Ltd.)

Test tube for NMR measurement: 5-mm test tube

Solvent: Deuterated chloroform (1 mL)

Temperature of sample: 20° C.

Mass of sample: 20 mg

Number of times of accumulation: 128 times

Internal standard substance of chemical shift: Tetramethylsilane (TMS)

The specific vinyl resin may for example further include at least one of a repeating unit derived from the compound (2) and a repeating unit derived from the compound (3) in addition to the repeating unit (1-1) and the repeating unit (1-2).

In a composition in which at least one of the first thermoplastic resin and the second thermoplastic resin is the specific vinyl resin, Tg of the specific vinyl resin is a value obtained by measuring the vinyl resin before the amide bond and the ester bond are formed through a reaction with the toner cores (the vinyl resin including no repeating unit (1-2)).

In a composition in which the binder resin in the toner cores contains a polyester resin including a repeating unit derived from terephthalic acid, and the first thermoplastic resin and the second thermoplastic resin are each a copolymer of one or more monomers including at least the compound (1), the terephthalic acid is preferably contained in an amount of no greater than 100 mass ppm as measured under conditions described below. That is, 2 g of the toner according to the present embodiment and 50 g of distilled water at a temperature of 50° C. are mixed under stirring, and the resultant mixture is centrifuged to collect supernatant. The amount of terephthalic acid contained in the thus collected supernatant (also referred to below as a terephthalic acid content) is preferably no greater than 100 mass ppm. The terephthalic acid in the supernatant is a material remaining unreacted in synthesis of the polyester resin (a residual monomer). As a result of the terephthalic acid content being no greater than 100 mass ppm, the binder resin can be prevented from bleeding out of the toner cores (particularly, the low-molecular component of the binder resin can be prevented from bleeding out of the toner cores), making it possible to obtain a toner further improved in heat-resistant preservability. In order to reduce the manufacturing cost of the toner, the terephthalic acid content is preferably at least 10 mass ppm. In a composition in which the binder resin in the toner cores contains a plurality of polyester resins, the above-described "polyester resin having a repeating unit derived from terephthalic acid" is at least one of the plurality of polyester resins.

Preferably, the terephthalic acid content is measured by high-performance liquid chromatography (also referred to below as HPLC). When the terephthalic acid content is measured by HPLC, preferably, the supernatant is filtered (for example, through a filter having a pore size of 0.45 μm), and then the amount of the terephthalic acid contained in the resultant filtrate is measured by HPLC in order to prevent column clogging. Hereinafter, the terephthalic acid content is equivalent to the "amount of the terephthalic acid contained in the filtrate" when measured using the filtrate obtained by filtering the supernatant. The terephthalic acid content is equivalent to the "amount of terephthalic acid contained in the supernatant" when measured using the supernatant unfiltered. The terephthalic acid content is measured by HPLC according to the same method as described below in association with Examples or a method conforming therewith.

(Second Shell Layer)

The second shell layers contain the third thermoplastic resin (the hydrophobic resin). The third thermoplastic resin is more hydrophobic than the first thermoplastic resin and is more hydrophobic than the second thermoplastic resin. The third thermoplastic resin has a higher glass transition point than the first thermoplastic resin. No particular limitations are placed on the third thermoplastic resin other than having the above-described features. In order to ensure that the third thermoplastic resin is more hydrophobic, however, the third thermoplastic resin is preferably a thermoplastic resin that does not include a repeating unit having a hydrophilic group (specific examples include a hydroxy group, a carboxy group, an amino group, and an oxazoline group).

In order to obtain a toner further improved in anti-fogging performance, the third thermoplastic resin is preferably a styrene-alkyl acrylate-based resin. The styrene-alkyl acrylate-based resin is a copolymer of at least one styrene-based monomer and at least one alkyl acrylate-based monomer. Tg of a resulting copolymer (thermoplastic resin) can be adjusted by changing at least one of the type of the styrene-based monomer, the type of the alkyl acrylate-based monomer, and a mole ratio of the alkyl acrylate-based monomer to the styrene-based monomer in copolymerization.

Examples of monomers that can be preferably used for synthesis of the styrene-alkyl acrylate-based resin include styrene-based monomers and alkyl acrylate-based monomers listed below.

Examples of preferable styrene-based monomers include styrene, alkyl styrenes, and halogenated styrenes. Examples of alkyl styrenes that can be used include α-methylstyrene, m-methylstyrene, p-methylstyrene, p-ethylstyrene, and 4-t-butylstyrene. Examples of halogenated styrenes that can be used include α-chlorostyrene, o-chlorostyrene, m-chlorostyrene, and p-chlorostyrene.

Examples of preferable alkyl acrylate-based monomers include alkyl (meth)acrylates. Examples of alkyl (meth) acrylates that can be used include methyl (meth)acrylate, ethyl (meth)acrylate, propyl (meth)acrylate, n-butyl (meth) acrylate, and 2-ethylhexyl (meth)acrylate.

In order to obtain a toner further improved in anti-fogging performance, the third thermoplastic resin is preferably a copolymer of styrene and at least one alkyl (meth)acrylate.

(Combination of Materials)

In order to obtain a toner further improved in low-temperature fixability, heat-resistant preservability, and anti-fogging performance, preferably, the first thermoplastic resin and the second thermoplastic resin are each a polymer of one or more monomers including at least the compound (1), and the third thermoplastic resin is a copolymer of styrene and at least one alkyl (meth)acrylate. More preferably, for the same reason, the first thermoplastic resin and the second thermoplastic resin are each a polymer of one or more monomers including at least the compound (1), the third thermoplastic resin is a copolymer of styrene and at least one alkyl (meth)acrylate, and the glass transition point of the third thermoplastic resin is at least 10° C. higher than the glass transition point of the first thermoplastic resin.

(External Additive)

The toner particles may further include an external additive. The external additive is added for example by using the toner particles 10 illustrated in FIG. 1 as toner mother particles and stirring the toner mother particles (a powder) and external additive particles (a powder) together to cause the external additive particles to adhere to surfaces of the toner mother particles.

Examples of preferable external additive particles include resin particles and inorganic particles. Examples of preferable inorganic particles include silica particles and particles of a metal oxide (specific examples include alumina, titanium oxide, magnesium oxide, zinc oxide, strontium titanate, and barium titanate). According to the present embodiment, one type of external additive particles may be used independently, or two or more types of external additive particles may be used in combination.

In order to allow the external additive to sufficiently exhibit its function while inhibiting detachment of the external additive particles from the toner mother particles, an amount of the external additive (in a situation in which plural types of external additive particles are used, a total amount of the external additive particles) is preferably at least 0.5 parts by mass and no greater than 10 parts by mass relative to 100 parts by mass of the toner mother particles.

In order to obtain a toner having excellent fluidity, it is preferable to use inorganic particles (a powder) having a number average primary particle diameter of at least 5 nm and no greater than 500 nm as the external additive particles.

The external additive particles may be surface-treated particles. For example, in a situation in which silica particles are used as the external additive particles, either or both of hydrophobicity and positive chargeability may be imparted to surfaces of the silica particles using a surface treatment agent. Examples of surface treatment agents that can be used include coupling agents (specific examples include silane coupling agents, titanate coupling agents, and aluminate coupling agents), silazane compounds (specific examples include chain silazane compounds and cyclic silazane compounds), and silicone oils (specific examples include dimethylsilicone oil). Particularly preferably, the surface treatment agent is a silane coupling agent or a silazane compound. Examples of preferable silane coupling agents include silane compounds (specific examples include methyltrimethoxysilane and aminosilane). Examples of preferable silazane compounds include hexamethyldisilazane (HMDS). When a surface of a silica base (untreated silica particles) is treated with the surface treatment agent, some or all of a large number of hydroxy groups (—OH) present in the surface of the silica base are replaced by functional groups derived from the surface treatment agent. As a result, silica particles having the functional groups derived from the surface treatment agent (specifically, functional groups that are more hydrophobic and/or more readily positively chargeable than the hydroxy groups) in surfaces thereof are obtained.

<Toner Production Method>

The following describes a preferable production method of the toner according to the embodiment described above. Elements that have been already described in the explanation of the toner according to the above embodiment will not be redundantly described below.

[Toner Core Preparation]

First, the toner cores are prepared by an aggregation method or a pulverization method.

The aggregation method for example includes an aggregation process and a coalescing process. In the aggregation process, fine particles of toner core components are caused to aggregate in an aqueous medium to form aggregated particles. In the coalescing process, the components in the aggregated particles are caused to coalesce in the aqueous medium to form toner cores.

The following describes the pulverization method. The toner cores can be prepared relatively easily at a low manufacturing cost by the pulverization method. Toner core preparation by the pulverization method for example includes a melt-kneading process and a pulverizing process. Toner core preparation by the pulverization method may further include a mixing process before the melt-kneading process. Toner core preparation by the pulverization method may further include at least one of a finely pulverizing process and a classification process after the pulverizing process.

In the mixing process, for example, a binder resin and an optional internal additive are mixed to obtain a mixture. In the melt-kneading process, a toner material is melt-kneaded to obtain a melt-kneaded product. The toner material is for example the mixture obtained through the mixing process. In the pulverizing process, the melt-kneaded product obtained as described above is cooled to for example room temperature (25° C.) and pulverized to obtain a pulverized product. In a situation in which the size of the pulverized product obtained through the pulverizing process needs to be reduced, a process of further pulverizing the pulverized product (the finely pulverizing process) may be performed. In a situation in which the size of the pulverized product needs to be uniform, a process of classifying the pulverized product (the classification process) may be performed. The pulverized product obtained through the above-described processes is used as the toner cores.

[First Shell Layer Formation]

Next, the toner cores obtained as described above, a material for forming the first shell layers (a shell material), and water (for example, ion exchanged water) are placed in a vessel. Subsequently, the internal temperature of the vessel is increased up to a specific temperature (for example, a temperature of at least 60° C. and no greater than 70° C.) while the vessel contents are stirred. The shell material is for example an aqueous solution of a polymer of one or more monomers including at least the compound (1) (also referred to below as an aqueous oxazoline group-containing macromolecule solution). The aqueous oxazoline group-containing macromolecule solution for example contains two oxazoline group-containing macromolecules each having a different Tg (more specifically, an oxazoline group-containing macromolecule for formation of the first domains and an oxazoline group-containing macromolecule for formation of the second domains). The following describes an example in which the toner cores contain a polyester resin as the binder resin and the aqueous oxazoline group-containing macromolecule solution is used as the shell material for formation of the first shell layers.

The internal temperature of the vessel is increased at a heating rate of for example at least 0.4° C./minute and no greater than 0.6° C./minute. A ring-opening agent (for example, an aqueous acetic acid solution) for promoting ring-opening of the oxazoline group in the shell material may be added during the heating. Alternatively or additionally, the shell material may be added during the heating.

Once the internal temperature of the vessel reaches the specific temperature, the vessel contents are stirred while the specific temperature is kept for a predetermined period of time (for example, 30 minutes to 90 minutes). As a result, some of oxazoline groups present in the molecules of the oxazoline group-containing macromolecule react with carboxy groups present in the surfaces of the toner cores (carboxy groups in the polyester resin). Through the reaction, the oxazoline groups undergo ring-opening, and amide bonds and ester bonds are formed. As a result, the first shell layers covering the surfaces of the toner cores are formed, and the first shell layers are fixed to the surfaces of the toner cores. The first shell layer coverage ratio can be adjusted by changing at least one of the oxazoline group-containing macromolecule concentration (solid concentration) of the aqueous oxazoline group-containing macromolecule solution and the amount of the aqueous oxazoline group-containing macromolecule solution that is used. In a composition in which the binder resin of the toner cores contains a polyester resin including a repeating unit derived from terephthalic acid, the terephthalic acid content decreases with an increase in the first shell layer coverage ratio. The mass ratio of the second domains to the first domains (second domains/first domains) can for example be adjusted by changing the mass ratio between the two oxazoline group-containing macromolecules in the aqueous oxazoline group-containing macromolecule solution used as the shell material.

[Second Shell Layer Formation]

Subsequently, a suspension of particles of a hydrophobic resin (hydrophobic resin particles) is added into the vessel as a shell material for formation of the second shell layers. The suspension of the hydrophobic resin particles are referred to below as a hydrophobic resin particle suspension. Next, the vessel contents were stirred for a specific period of time (for example, 30 minutes to 90 minutes) while the internal temperature of the vessel is kept at a temperature of for example at least 60° C. and no greater than 70° C. Through the above, the hydrophobic resin particles contained in the hydrophobic resin particle suspension adhere to a portion of the surface of each first shell layer. As a result, the second shell layers each partially covering the surface of the corresponding first shell layer are formed. Next, the vessel contents are cooled to room temperature (25° C.) to obtain a toner mother particle-containing dispersion. The hydrophobic resin particles in the hydrophobic resin particle suspension have a number average primary particle diameter of for example at least 40 nm and no greater than 80 nm. The second shell layer coverage ratio can for example be adjusted by changing at least one of the hydrophobic resin particle concentration (solid concentration) of the hydrophobic resin particle suspension, the number average primary particle diameter of the hydrophobic resin particles in the hydrophobic resin particle suspension, and the amount of the hydrophobic resin particle suspension that is used.

[Washing and Drying]

The toner mother particles in the dispersion obtained as described above are washed with ion exchanged water, and then the toner mother particles are dried using for example a continuous type surface modifier. Through the above, a powder of the toner mother particles is obtained.

[External Additive Addition]

Thereafter, as necessary, an external additive may be caused to adhere to the surfaces of the toner mother particles obtained as described above by mixing the toner mother particles and the external additive using a mixer (for example, an FM mixer, product of Nippon Coke & Engineering Co., Ltd.). Note that the toner mother particles may be used as toner particles without undergoing external additive addition. Through the above, the toner (a powder of toner particles) according to the embodiment described above is obtained.

EXAMPLES

The following describes Examples of the present disclosure and Comparative Examples. First, methods for measuring softening point (Tm), glass transition point (Tg), and melting point (Mp) will be described.

<Measurement of Tm>

A capillary rheometer ("CFT-500D", product of Shimadzu Corporation) was charged with a sample (specifically, a resin, resin particles, or toner cores). Subsequently, melt-flow of 1 $cm^3$ of the sample was caused under conditions of a die pore diameter of 1 mm, a plunger load of 20 $kg/cm^2$, and a heating rate of 6° C./minute to plot an S-shaped curve (horizontal axis: temperature, vertical axis: stroke) of the sample. The softening point of the sample was read from the thus obtained S-shaped curve. The softening point (Tm) of the sample is a temperature on the S-shaped curve corresponding to a stroke value of "$(S_1+S_2)/2$", where $S_1$ represents a maximum stroke value and $S_2$ represents a base line stroke value at low temperatures.

<Measurement of Tg and Mp>

A differential scanning calorimeter ("DSC-6220", product of Seiko Instruments Inc.) was used as a measuring device. First, 55 mg of a sample (specifically, a resin, resin particles, or toner cores) was placed in an aluminum pan (aluminum container) and the aluminum pan was set on a measurement section of the measuring device. An empty aluminum pan was used as a reference. Next, the temperature of the measurement section was increased from −20° C., which is a measurement initiation temperature, to 170° C. at a rate of 10° C./minute (first heating: RUN 1). Thereafter, the temperature of the measurement section was reduced from 170°

C. to −20° C. at a rate of 10° C./minute. Subsequently, the temperature of the measurement section was increased from −20° C. to 170° C. at a rate of 10° C./minute (second heating: RUN 2). A heat absorption curve (vertical axis: heat flow (DSC signal), horizontal axis: temperature) of the sample was plotted in RUN 2. Tg and Mp of the sample were read from the thus obtained heat absorption curve. On the heat absorption curve, a temperature at a point of inflection (specifically, a temperature at an intersection point between an extrapolation of a base line and an extrapolation of an inclined portion of the curve) caused due to glass transition corresponds to the glass transition point (Tg) of the sample, and a temperature of an endothermic peak (i.e., a temperature corresponding to a maximum endothermic energy amount) resulting from heat of fusion corresponds to the melting point (Mp) of the sample.

<Synthesis of Binder Resin>

[Synthesis of Non-Crystalline Polyester Resin R-1]

A four-necked flask having a capacity of 10 L and equipped with a thermometer (a thermocouple), a drainage tube, a nitrogen inlet tube, and a stirrer was charged with 370 g of bisphenol A propylene oxide adduct (average number of moles of propylene oxide added: 2 mol), 3,059 g of bisphenol A ethylene oxide adduct (average number of moles of ethylene oxide added: 2 mol), 1,194 g of terephthalic acid, 286 g of fumaric acid, 10 g of tin(II) 2-ethylhexanoate, and 2 g of gallic acid. Subsequently, the flask contents were caused to react under a nitrogen atmosphere at 230° C. until a reaction completion rate reached 90% by mass. The reaction completion rate was calculated in accordance with the following expression: "reaction completion rate=100× actual amount of water generated by reaction/theoretical amount of water generated by reaction". Subsequently, the flask contents were caused to react under a reduced pressure atmosphere (pressure: 8.3 kPa) at 230° C. until a reaction product (a resin) having a Tm of 89° C. was obtained. Thus, a non-crystalline polyester resin R-1 (acid value: 5.3 mgKOH/g) was obtained. The non-crystalline polyester resin R-1 had a Tg of 50° C.

[Synthesis of Non-Crystalline Polyester Resin R-2]

A four-necked flask having a capacity of 10 L and equipped with a thermometer (a thermocouple), a drainage tube, a nitrogen inlet tube, and a stirrer was charged with 1,286 g of bisphenol A propylene oxide adduct (average number of moles of propylene oxide added: 2 mol), 2,218 g of bisphenol A ethylene oxide adduct (average number of moles of ethylene oxide added: 2 mol), 1,603 g of terephthalic acid, 10 g of tin(II) 2-ethylhexanoate, and 2 g of gallic acid. Subsequently, the flask contents were caused to react under a nitrogen atmosphere at 230° C. until the reaction completion rate represented by the above expression reached 90% by mass. Subsequently, the flask contents were caused to react under a reduced pressure atmosphere (pressure: 8.3 kPa) at 230° C. until a reaction product (a resin) having a Tm of 111° C. was obtained. Thus, a non-crystalline polyester resin R-2 (acid value: 25.0 mgKOH/g) was obtained. The non-crystalline polyester resin R-2 had a Tg of 69° C.

[Synthesis of Non-Crystalline Polyester Resin R-3]

A four-necked flask having a capacity of 10 L and equipped with a thermometer (a thermocouple), a drainage tube, a nitrogen inlet tube, and a stirrer was charged with 4,907 g of bisphenol A propylene oxide adduct (average number of moles of propylene oxide added: 2 mol), 1,942 g of bisphenol A ethylene oxide adduct (average number of moles of ethylene oxide added: 2 mol), 757 g of fumaric acid, 2,078 g of n-dodecylsuccinic acid anhydride, 30 g of tin(II) 2-ethylhexanoate, and 2 g of gallic acid. Subsequently, the flask contents were caused to react under a nitrogen atmosphere at 230° C. until the reaction completion rate represented by the above expression reached 90% by mass. The flask contents were then caused to react for 1 hour under a reduced pressure atmosphere (pressure: 8.3 kPa) at 230° C. Subsequently, 548 g of trimellitic anhydride was added into the flask, and the flask contents were caused to react under a reduced pressure atmosphere (pressure: 8.3 kPa) at 220° C. until a reaction product (a resin) having a Tm of 135° C. was obtained. Thus, a non-crystalline polyester resin R-3 (acid value: 13.0 mgKOH/g) was obtained. The non-crystalline polyester resin R-3 had a Tg of 58° C.

[Synthesis of Composite Resin of Crystalline Polyester Resin and Styrene-acrylic Acid Copolymer]

A four-necked flask having a capacity of 10 L and equipped with a thermometer (a thermocouple), a drainage tube, a nitrogen inlet tube, and a stirrer was charged with 2,643 g of 1,6-hexanediol, 864 g of 1,4-butanediol, and 2,945 g of succinic acid. Subsequently, the internal temperature of the flask was increased up to 160° C. to melt the flask contents. Next, a liquid mixture of 1,831 g of styrene, 161 g of acrylic acid, and 110 g of dicumyl peroxide was dripped into the flask over 1 hour using a dripping funnel. Next, the flask contents were caused to react for 1 hour under a nitrogen atmosphere at 170° C., and then unreacted styrene and unreacted acrylic acid were removed over 1 hour under a reduced pressure atmosphere (pressure: 8.3 kPa) at 120° C. Subsequently, the internal pressure of the flask was restored to the atmospheric pressure, and 40 g of tin(II) 2-ethylhexanoate and 3 g of gallic acid were added into the flask. Thereafter, the flask contents were caused to react for 8 hours under a nitrogen atmosphere at 210° C. Next, the flask contents were caused to react for 1 hour under a reduced pressure atmosphere (pressure: 8.3 kPa) at 210° C. to yield a composite resin of a crystalline polyester resin and a styrene-acrylic acid copolymer (referred to below as a composite resin R-4). The composite resin R-4 had an acid value of 2.2 mgKOH/g, a Tm of 92° C., an Mp of 96° C., and a crystallinity index (Tm/Mp) of 0.96.

<Preparation of Aqueous Oxazoline Group-Containing Macromolecule Solution>

[Preparation of Aqueous Oxazoline Group-Containing Macromolecule Solution OA]

A four-necked flask equipped with a thermometer (a thermocouple), a reflux condenser, a nitrogen inlet tube, and a stirrer was charged with 1,350 g of ion exchanged water, 5 g of sodium persulfate, 120 g of 2-vinyl-2-oxazoline as a monomer, and 3 g of 2-hydroxyethyl acrylate as a monomer. Next, the internal temperature of the flask was increased up to 50° C. under a flow of nitrogen, and then the flask contents were stirred at a rotational speed of 250 rpm for 10 hours while the internal temperature of the flask was kept at 50° C.±1° C. to cause a polymerization reaction of the monomers. Next, the flask contents were cooled to 25° C. to yield an aqueous oxazoline group-containing macromolecule solution OA (solid concentration: 10.0% by mass). The oxazoline group-containing macromolecule (thermoplastic resin) in the aqueous oxazoline group-containing macromolecule solution OA had a Tg of 108° C. The value of Tg of the oxazoline group-containing macromolecule in the aqueous oxazoline group-containing macromolecule solution OA was determined using, as a measurement target, a resin (solid) obtained by drying the aqueous oxazoline group-containing macromolecule solution OA in an oven set at 100° C. The same applies to Tg of the oxazoline group-containing macromolecule in each of aqueous oxazoline group-containing macromolecule solutions described below.

[Preparation of Aqueous Oxazoline Group-Containing Macromolecule Solution OB]

An aqueous oxazoline group-containing macromolecule solution OB (solid concentration: 10.0% by mass) was obtained according to the same method as in the preparation of the aqueous oxazoline group-containing macromolecule solution OA in all aspects other than that only 120 g of 2-vinyl-2-oxazoline was used as a monomer. The oxazoline group-containing macromolecule (thermoplastic resin) in the aqueous oxazoline group-containing macromolecule solution OB had a Tg of 101° C.

[Preparation of Aqueous Oxazoline Group-Containing Macromolecule Solution OC]

An aqueous oxazoline group-containing macromolecule solution OC (solid concentration: 5.0% by mass) was obtained according to the same method as in the preparation of the aqueous oxazoline group-containing macromolecule solution OA in all aspects other than that the monomers that were caused to react were changed to 30 g of 2-vinyl-2-oxazoline and 35 g of methyl acrylate. The oxazoline group-containing macromolecule (thermoplastic resin) in the aqueous oxazoline group-containing macromolecule solution OC had a Tg of 71° C.

[Preparation of Aqueous Oxazoline Group-Containing Macromolecule Solution OD]

An aqueous oxazoline group-containing macromolecule solution OD (solid concentration: 6.0% by mass) was obtained according to the same method as in the preparation of the aqueous oxazoline group-containing macromolecule solution OA in all aspects other than that the monomers that were caused to react were changed to 30 g of 2-vinyl-2-oxazoline and 45 g of methyl acrylate. The oxazoline group-containing macromolecule (thermoplastic resin) in the aqueous oxazoline group-containing macromolecule solution OD had a Tg of 66° C.

[Preparation of Aqueous Oxazoline Group-Containing Macromolecule Solution OE]

An aqueous oxazoline group-containing macromolecule solution OE (solid concentration: 5.0% by mass) was obtained according to the same method as in the preparation of the aqueous oxazoline group-containing macromolecule solution OA in all aspects other than that the monomers that were caused to react were changed to 30 g of 2-vinyl-2-oxazoline, 25 g of methyl acrylate, and 10 g of n-butyl acrylate. The oxazoline group-containing macromolecule (thermoplastic resin) in the aqueous oxazoline group-containing macromolecule solution OE had a Tg of 36° C.

[Preparation of Aqueous Oxazoline Group-Containing Macromolecule Solution OF]

An aqueous oxazoline group-containing macromolecule solution OF (solid concentration: 5.0% by mass) was obtained according to the same method as in the preparation of the aqueous oxazoline group-containing macromolecule solution OA in all aspects other than that the monomers that were caused to react were changed to 30 g of 2-vinyl-2-oxazoline, 20 g of methyl acrylate, and 15 g of n-butyl acrylate. The oxazoline group-containing macromolecule (thermoplastic resin) in the aqueous oxazoline group-containing macromolecule solution OF had a Tg of 32° C.

<Preparation of Hydrophobic Resin Particle Suspension>

[Preparation of Hydrophobic Resin Particle Suspension RP-1]

A three-necked flask having a capacity of 2 L and equipped with a thermometer and a stirring impeller was charged with 875 mL of ion exchanged water and 5 mL of a cationic surfactant ("TEXNOL (registered Japanese trademark) R5, product of NIPPON NYUKAZAI CO., LTD., ingredient: alkyl benzyl ammonium salt). Next, the internal temperature of the flask was increased up to 80° C. using a water bath, and subsequently two liquids (a first liquid and a second liquid) were dripped into the flask over 5 hours. The first liquid was a liquid mixture of 12 mL of styrene, 5 mL of ethyl methacrylate, and 3 mL of methyl acrylate. The second liquid was a solution of 0.5 g of potassium peroxodisulfate in 30 mL of ion exchanged water. Subsequently, the flask contents were stirred at a rotational speed of 250 rpm for 2 hours while the internal temperature of the flask was kept at 80° C. to cause polymerization of the flask contents. As a result, a hydrophobic resin particle suspension RP-1 (solid concentration: 5.0% by mass) was obtained. The hydrophobic resin particles (particles of the resultant styrene-alkyl acrylate-based resin) in the hydrophobic resin particle suspension RP-1 had a number average primary particle diameter of 48 nm and a Tg of 81° C. The values of the number average primary particle diameter and Tg of the hydrophobic resin particles in the hydrophobic resin particle suspension RP-1 were determined using, as a measurement target, particles (solid) of the resultant hydrophobic resin (thermoplastic resin) obtained by drying the hydrophobic resin particle suspension RP-1 in an oven set at 100° C. The same applies to the number average primary particle diameter and Tg of the hydrophobic resin particles in each of hydrophobic resin particle suspensions described below.

[Preparation of Hydrophobic Resin Particle Suspension RP-2]

A hydrophobic resin particle suspension RP-2 (solid concentration: 4.5% by mass) was obtained according to the same method as in the preparation of the hydrophobic resin particle suspension RP-1 in all aspects other than that the amount of the cationic surfactant ("TEXNOL (registered Japanese trademark) R5, product of NIPPON NYUKAZAI CO., LTD.) was changed to 75 mL, and the first liquid was changed to a liquid mixture of 12 mL of styrene, 3 mL of n-butyl methacrylate, and 4 mL of n-butyl acrylate. The hydrophobic resin particles (particles of the resultant styrene-alkyl acrylate-based resin) in the hydrophobic resin particle suspension RP-2 had a number average primary particle diameter of 75 nm and a Tg of 35° C.

[Preparation of Hydrophobic Resin Particle Suspension RP-3]

A hydrophobic resin particle suspension RP-3 (solid concentration: 4.5% by mass) was obtained according to the same method as in the preparation of the hydrophobic resin particle suspension RP-1 in all aspects other than that the first liquid was changed to a liquid mixture of 12 mL of styrene, 2 mL of ethyl methacrylate, and 5 mL of ethyl acrylate. The hydrophobic resin particles (particles of the resultant styrene-alkyl acrylate-based resin) in the hydrophobic resin particle suspension RP-3 had a number average primary particle diameter of 67 nm and a Tg of 48° C.

<Production of Toners TA-1 to TA-7 and TB-1 to TB-6>

The following describes production methods of the toners TA-1 to TA-7 and TB-1 to TB-6. The following description is on the assumption that among two thermoplastic resins forming the first shell layers covering the surfaces of the toner cores, the thermoplastic resin having a lower Tg is the first thermoplastic resin and the thermoplastic resin having a higher Tg is the second thermoplastic resin. The following description is also on the assumption that a resin forming the second shell layers partially covering the surfaces of the first shell layers is the third thermoplastic resin.

[Production of Toner TA-1]

(Toner Core Preparation)

An FM mixer ("FM-20B", product of Nippon Coke & Engineering Co., Ltd.) was used to mix 300 g of the non-crystalline polyester resin R-1, 100 g of the non-crystalline polyester resin R-2, 600 g of the non-crystalline polyester resin R-3, 100 g of the composite resin R-4, 12 g of a first releasing agent ("CARNAUBA WAX No. 1", product of S. Kato & Co., ingredient: carnauba wax), 48 g of a second releasing agent ("NISSAN ELECTOL (registered Japanese trademark) WEP-3", product of NOF Corporation, ingredient: synthetic ester wax), and 144 g of a colorant ("COLORTEX (registered Japanese trademark) Blue B1021", product of SANYO COLOR WORKS, Ltd., ingredient: Phthalocyanine Blue) at a rotational speed of 2,400 rpm.

Subsequently, the resultant mixture was melt-kneaded using a twin-screw extruder ("PCM-30", product of Ikegai Corp.) under conditions of a material feeding rate of 5 kg/hour, a shaft rotational speed of 160 rpm, and a set temperature (cylinder temperature) of 100° C. Thereafter, the resultant kneaded product was cooled. After the cooling, the kneaded product was coarsely pulverized using a pulverizer ("ROTOPLEX 16/8", product of former TOA MACHINERY MFG.). Subsequently, the resultant coarsely pulverized product was finely pulverized using a jet mill ("Model-I SUPER SONIC JET MILL", product of Nippon Pneumatic Mfg.). Subsequently, the resultant finely pulverized product was classified using a classifier ("ELBOW JET Type EJ-LABO", product of Nittetsu Mining Co., Ltd.). As a result, toner cores having a Tm of 90° C., a Tg of 49° C., and a volume median diameter ($D_{50}$) of 6.7 μm were obtained.

(First Shell Layer Formation)

A three-necked flask having a capacity of 1 L and equipped with a thermometer and a stirring impeller was set up in a water bath, and 300 mL of ion exchanged water was added into the flask. Thereafter, the internal temperature of the flask was kept at 30° C. using the water bath. Subsequently, 12.0 g of the aqueous oxazoline group-containing macromolecule solution OE and 28.0 g of the aqueous oxazoline group-containing macromolecule solution OC were added into the flask, and then the flask contents were stirred. Subsequently, 300 g of the toner cores obtained as described above were added into the flask, and the flask contents were stirred at a rotational speed of 200 rpm for 1 hour. Thereafter, 300 mL of ion exchanged water was added into the flask. Subsequently, the internal temperature of the flask was increased up to 68° C. at a rate of 0.5° C./minute while the flask contents were stirred at a rotational speed of 250 rpm. Subsequently, the flask contents were kept at the same temperature (68° C.) for 1 hour under stirring at a rotational speed of 100 rpm. The first shell layers covering the surfaces of the toner cores were formed while the flask contents were kept at 68° C. The first shell layers included only the first domains composed of the first thermoplastic resin (formed from the oxazoline group-containing macromolecule in the aqueous oxazoline group-containing macromolecule solution OE) and the second domains composed of the second thermoplastic resin (formed from the oxazoline group-containing macromolecule in the aqueous oxazoline group-containing macromolecule solution OC). The mass ratio of the second domains to the first domains (second domains/first domains) in the first shell layers was 2.5.

(Second Shell Layer Formation)

Subsequently, 10 g of the hydrophobic resin particle suspension RP-1 was added into the flask, and then the flask contents were kept at 68° C. for 1 hour under stirring at a rotational speed of 100 rpm. The second shell layers partially covering the surfaces of the first shell layers were formed while the flask contents were kept at 68° C. The second shell layers covered only the first domains of the surfaces of the first shell layers. The second shell layers were composed of the third thermoplastic resin (the hydrophobic resin forming the hydrophobic resin particles in the hydrophobic resin particle suspension RP-1) that is more hydrophobic than the first thermoplastic resin and the second thermoplastic resin. Next, the flask contents were cooled to room temperature (25° C.) to obtain a toner mother particle-containing dispersion.

(Washing)

The toner mother particle-containing dispersion obtained as described above was filtered using a Buchner funnel (solid-liquid separation) to collect a wet cake of the toner mother particles. The wet cake of the toner mother particles was dispersed in ion exchanged water, and the resultant dispersion was filtered using a Buchner funnel. Furthermore, dispersion and filtering were repeated five times to wash the toner mother particles.

(Drying)

Subsequently, the washed toner mother particles were dispersed in a 50% by mass aqueous ethanol solution. As a result, a slurry of the toner mother particles was obtained. Subsequently, the toner mother particles in the slurry were dried using a continuous type surface modifier ("COATMIZER" (registered Japanese trademark)", product of Freund Corporation) under conditions of a hot air flow temperature of 45° C. and a blower flow rate of 2 $m^3$/minute.

(External Additive Addition)

An FM mixer (product of Nippon Coke & Engineering Co., Ltd.) having a capacity of 10 L was used to mix 100 parts by mass of the dried toner mother particles, 1.50 parts by mass of hydrophobic fumed silica particles ("AEROSIL (registered Japanese trademark) R972", product of Nippon Aerosil Co., Ltd., hydrophobing agent: dimethyldichlorosilane (DDS), number average primary particle diameter: 16 nm), 1.00 part by mass of conductive titanium oxide particles ("EC-100", product of Titan Kogyo, Ltd., base: $TiO_2$ particles, coat layer: Sb-doped $SnO_2$ film, number average primary particle diameter: 0.35 μm), and 1.25 parts by mass of cross-linked resin particles (resin: cross-linked styrene-acrylic acid-based resin, number average primary particle diameter: 0.08 μm) for 10 minutes to cause the external additives (the hydrophobic fumed silica particles, the conductive titanium oxide particles, and the cross-linked resin particles) to adhere to the surfaces of the toner mother particles. The hydrophobic fumed silica particles were broken up using a jet mill ("Model-I SUPER SONIC JET MILL", product of Nippon Pneumatic Mfg.) before use. Sifting was performed on the resultant powder (a powder of the toner mother particles having the external additives adhering thereto) using a 200-mesh sieve (pore size: 75 μm). As a result, a positively chargeable toner TA-1 was obtained.

[Production of Toner TA-2]

The positively chargeable toner TA-2 was obtained according to the same method as in the production of the toner TA-1 in all aspects other than that the aqueous oxazoline group-containing macromolecule solution was changed to 12.0 g of the aqueous oxazoline group-containing macromolecule solution OE and 7.0 g of the aqueous oxazoline group-containing macromolecule solution OB in the first shell layer formation. The first shell layers of the toner TA-2 included only the first domains composed of the first thermoplastic resin (formed from the oxazoline group-containing macromolecule in the aqueous oxazoline group-containing macromolecule solution OE) and the second domains composed of the second thermoplastic resin (formed from the oxazoline group-containing macromolecule in the aqueous oxazoline group-containing macromolecule solution OB). The mass ratio of the second domains to the first domains (second domains/first domains) in the first shell layers of the toner TA-2 was 0.5. The second shell layers of the toner TA-2 were composed of the third thermoplastic resin (the hydrophobic resin forming the hydrophobic resin particles in the hydrophobic resin particle suspension RP-1) that was more hydrophobic than the first thermoplastic resin and the second thermoplastic resin.

[Production of Toner TA-3]

The positively chargeable toner TA-3 was obtained according to the same method as in the production of the toner TA-1 in all aspects other than that the aqueous oxazoline group-containing macromolecule solution was changed to 12.0 g of the aqueous oxazoline group-containing macromolecule solution OD and 7.0 g of the aqueous oxazoline group-containing macromolecule solution OB in the first shell layer formation. The first shell layers of the toner TA-3 included only the first domains composed of the first thermoplastic resin (formed from the oxazoline group-containing macromolecule in the aqueous oxazoline group-containing macromolecule solution OD) and the second domains composed of the second thermoplastic resin (formed from the oxazoline group-containing macromolecule in the aqueous oxazoline group-containing macromolecule solution OB). The mass ratio of the second domains to the first domains (second domains/first domains) in the first shell layers of the toner TA-3 was 0.6. The second shell layers of the toner TA-3 were composed of the third thermoplastic resin (the hydrophobic resin forming the hydrophobic resin particles in the hydrophobic resin particle suspension RP-1) that was more hydrophobic than the first thermoplastic resin and the second thermoplastic resin.

[Production of Toner TA-4]

The positively chargeable toner TA-4 was obtained according to the same method as in the production of the toner TA-1 in all aspects other than that the aqueous oxazoline group-containing macromolecule solution was changed to 12.0 g of the aqueous oxazoline group-containing macromolecule solution OD and 28.0 g of the aqueous oxazoline group-containing macromolecule solution OC in the first shell layer formation. The first shell layers of the toner TA-4 included only the first domains composed of the first thermoplastic resin (formed from the oxazoline group-containing macromolecule in the aqueous oxazoline group-containing macromolecule solution OD) and the second domains composed of the second thermoplastic resin (formed from the oxazoline group-containing macromolecule in the aqueous oxazoline group-containing macromolecule solution OC). The mass ratio of the second domains to the first domains (second domains/first domains) in the first shell layers of the toner TA-4 was 2.4. The second shell layers of the toner TA-4 were composed of the third thermoplastic resin (the hydrophobic resin forming the hydrophobic resin particles in the hydrophobic resin particle suspension RP-1) that was more hydrophobic than the first thermoplastic resin and the second thermoplastic resin.

[Production of Toner TA-5]

The positively chargeable toner TA-5 was obtained according to the same method as in the production of the toner TA-1 in all aspects other than that the aqueous oxazoline group-containing macromolecule solution was changed to 7.0 g of the aqueous oxazoline group-containing macromolecule solution OE and 4.0 g of the aqueous oxazoline group-containing macromolecule solution OB in the first shell layer formation. The first shell layers of the toner TA-5 included only the first domains composed of the first thermoplastic resin (formed from the oxazoline group-containing macromolecule in the aqueous oxazoline group-containing macromolecule solution OE) and the second domains composed of the second thermoplastic resin (formed from the oxazoline group-containing macromolecule in the aqueous oxazoline group-containing macromolecule solution OB). The mass ratio of the second domains to the first domains (second domains/first domains) in the first shell layers of the toner TA-5 was 0.5. The second shell layers of the toner TA-5 were composed of the third thermoplastic resin (the hydrophobic resin forming the hydrophobic resin particles in the hydrophobic resin particle suspension RP-1) that was more hydrophobic than the first thermoplastic resin and the second thermoplastic resin.

[Production of Toner TA-6]

The positively chargeable toner TA-6 was obtained according to the same method as in the production of the toner TA-1 in all aspects other than that the hydrophobic resin particle suspension was changed to 10 g of the hydrophobic resin particle suspension RP-3 in the second shell layer formation. The first shell layers of the toner TA-6 included only the first domains composed of the first thermoplastic resin (formed from the oxazoline group-containing macromolecule in the aqueous oxazoline group-containing macromolecule solution OE) and the second domains composed of the second thermoplastic resin (formed from the oxazoline group-containing macromolecule in the aqueous oxazoline group-containing macromolecule solution OC). The mass ratio of the second domains to the first domains (second domains/first domains) in the first shell layers of the toner TA-6 was 2.5. The second shell layers of the toner TA-6 were composed of the third thermoplastic resin (the hydrophobic resin forming the hydrophobic resin particles in the hydrophobic resin particle suspension RP-3) that was more hydrophobic than the first thermoplastic resin and the second thermoplastic resin.

[Production of Toner TA-7]

The positively chargeable toner TA-7 was obtained according to the same method as in the production of the toner TA-1 in all aspects other than that the aqueous oxazoline group-containing macromolecule solution was changed to 5.0 g of the aqueous oxazoline group-containing macromolecule solution OE and 2.5 g of the aqueous oxazoline group-containing macromolecule solution OB in the first shell layer formation. The first shell layers of the toner TA-7 included only the first domains composed of the first thermoplastic resin (formed from the oxazoline group-containing macromolecule in the aqueous oxazoline group-containing macromolecule solution OE) and the second domains composed of the second thermoplastic resin (formed from the oxazoline group-containing macromolecule in the aqueous oxazoline group-containing macromolecule solution OB). The mass ratio of the second domains to the first domains (second domains/first domains) in the first shell layers of the toner TA-7 was 0.5. The second shell layers of the toner TA-7 were composed of the third thermoplastic resin (the hydrophobic resin forming the hydrophobic resin particles in the hydrophobic resin particle suspension RP-1) that was more hydrophobic than the first thermoplastic resin and the second thermoplastic resin.

[Production of Toner TB-1]

The positively chargeable toner TB-1 was obtained according to the same method as in the production of the toner TA-1 in all aspects other than that the aqueous oxazoline group-containing macromolecule solution was changed to 12.0 g of the aqueous oxazoline group-containing macromolecule solution OE and 28.0 g of the aqueous oxazoline group-containing macromolecule solution OD in the first shell layer formation. The first shell layers of the toner TB-1 included only the first domains composed of the first thermoplastic resin (formed from the oxazoline group-containing macromolecule in the aqueous oxazoline group-containing macromolecule solution OE) and the second domains composed of the second thermoplastic resin (formed from the oxazoline group-containing macromolecule in the aqueous oxazoline group-containing macromolecule solution OD). The mass ratio of the second domains to the first domains (second domains/first domains) in the first shell layers of the toner TB-1 was 2.6. The second shell layers of the toner TB-1 were composed of the third thermoplastic resin (the hydrophobic resin forming the hydrophobic resin particles in the hydrophobic resin particle suspension RP-1) that was more hydrophobic than the first thermoplastic resin and the second thermoplastic resin.

[Production of Toner TB-2]

The positively chargeable toner TB-2 was obtained according to the same method as in the production of the toner TA-1 in all aspects other than that the aqueous oxazoline group-containing macromolecule solution was changed to 12.0 g of the aqueous oxazoline group-containing macromolecule solution OC and 7.0 g of the aqueous oxazoline group-containing macromolecule solution OB in the first shell layer formation. The first shell layers of the toner TB-2 included only the first domains composed of the first thermoplastic resin (formed from the oxazoline group-containing macromolecule in the aqueous oxazoline group-containing macromolecule solution OC) and the second domains composed of the second thermoplastic resin (formed from the oxazoline group-containing macromolecule in the aqueous oxazoline group-containing macromolecule solution OB). The mass ratio of the second domains to the first domains (second domains/first domains) in the first shell layers of the toner TB-2 was 0.6. The second shell layers of the toner TB-2 were composed of the third thermoplastic resin (the hydrophobic resin forming the hydrophobic resin particles in the hydrophobic resin particle suspension RP-1) that was more hydrophobic than the first thermoplastic resin and the second thermoplastic resin.

[Production of Toner TB-3]

The positively chargeable toner TB-3 was obtained according to the same method as in the production of the toner TA-1 in all aspects other than that the aqueous oxazoline group-containing macromolecule solution was changed to 12.0 g of the aqueous oxazoline group-containing macromolecule solution OF and 28.0 g of the aqueous oxazoline group-containing macromolecule solution OC in the first shell layer formation. The first shell layers of the toner TB-3 included only the first domains composed of the first thermoplastic resin (formed from the oxazoline group-containing macromolecule in the aqueous oxazoline group-containing macromolecule solution OF) and the second domains composed of the second thermoplastic resin (formed from the oxazoline group-containing macromolecule in the aqueous oxazoline group-containing macromolecule solution OC). The mass ratio of the second domains to the first domains (second domains/first domains) in the first shell layers of the toner TB-3 was 2.6. The second shell layers of the toner TB-3 were composed of the third thermoplastic resin (the hydrophobic resin forming the hydrophobic resin particles in the hydrophobic resin particle suspension RP-1) that was more hydrophobic than the first thermoplastic resin and the second thermoplastic resin.

[Production of Toner TB-4]

The positively chargeable toner TB-4 was obtained according to the same method as in the production of the toner TA-1 in all aspects other than that the aqueous oxazoline group-containing macromolecule solution was changed to 12.0 g of the aqueous oxazoline group-containing macromolecule solution OD and 7.0 g of the aqueous oxazoline group-containing macromolecule solution OA in the first shell layer formation. The first shell layers of the toner TB-4 included only the first domains composed of the first thermoplastic resin (formed from the oxazoline group-containing macromolecule in the aqueous oxazoline group-containing macromolecule solution OD) and the second domains composed of the second thermoplastic resin (formed from the oxazoline group-containing macromolecule in the aqueous oxazoline group-containing macromolecule solution OA). The mass ratio of the second domains to the first domains (second domains/first domains) in the first shell layers of the toner TB-4 was 0.5. The second shell layers of the toner TB-4 were composed of the third thermoplastic resin (the hydrophobic resin forming the hydrophobic resin particles in the hydrophobic resin particle suspension RP-1) that was more hydrophobic than the first thermoplastic resin and the second thermoplastic resin.

[Production of Toner TB-5]

The positively chargeable toner TB-5 was obtained according to the same method as in the production of the toner TA-1 in all aspects other than that the hydrophobic resin particle suspension was changed to 10 g of the hydrophobic resin particle suspension RP-2 in the second shell layer formation. The first shell layers of the toner TB-5 included only the first domains composed of the first thermoplastic resin (formed from the oxazoline group-containing macromolecule in the aqueous oxazoline group-containing macromolecule solution OE) and the second domains composed of the second thermoplastic resin (formed from the oxazoline group-containing macromolecule in the aqueous oxazoline group-containing macromolecule solution OC). The mass ratio of the second domains to the first domains (second domains/first domains) in the first shell layers of the toner TB-5 was 2.6. The second shell layers of the toner TB-5 were composed of the third thermoplastic resin (the hydrophobic resin forming the hydrophobic resin particles in the hydrophobic resin particle suspension RP-2) that was more hydrophobic than the first thermoplastic resin and the second thermoplastic resin.

[Production of Toner TB-6]

The toner TB-6 was obtained according to the same method as in the production of the toner TA-1 in all aspects other than that the flask contents were cooled to room temperature (25° C.) without going through the second shell layer formation after the first shell layer formation to obtain a toner mother particle-containing dispersion. The first shell layers of the toner TB-6 included only the first domains composed of the first thermoplastic resin (formed from the oxazoline group-containing macromolecule in the aqueous oxazoline group-containing macromolecule solution OE) and the second domains composed of the second thermoplastic resin (formed from the oxazoline group-containing macromolecule in the aqueous oxazoline group-containing macromolecule solution OC). The mass ratio of the second domains to the first domains (second domains/first domains) in the first shell layers of the toner TB-6 was 2.6.

Table 1 shows details of the first thermoplastic resin, the second thermoplastic resin, and the third thermoplastic resin with respect to each of the toners TA-1 to TA-7 and TB-1 to TB-6. As for the toner TB-6, only details of the first thermoplastic resin and the second thermoplastic resin are shown because the second shell layers were not formed.

TABLE 1

| Toner | First thermoplastic resin: Aqueous oxazoline group-containing macromolecule solution | Tg [° C.] | Second thermoplastic resin: Aqueous oxazoline group-containing macromolecule solution | Tg [° C.] | Third thermoplastic resin: Hydrophobic resin particle suspension | Tg [° C.] |
|---|---|---|---|---|---|---|
| TA-1 | OE | 36 | OC | 71 | RP-1 | 81 |
| TA-2 | OE | 36 | OB | 101 | RP-1 | 81 |
| TA-3 | OD | 66 | OB | 101 | RP-1 | 81 |
| TA-4 | OD | 66 | OC | 71 | RP-1 | 81 |
| TA-5 | OE | 36 | OB | 101 | RP-1 | 81 |
| TA-6 | OE | 36 | OC | 71 | RP-3 | 48 |
| TA-7 | OE | 36 | OB | 101 | RP-1 | 81 |
| TB-1 | OE | 36 | OD | 66 | RP-1 | 81 |
| TB-2 | OC | 71 | OB | 101 | RP-1 | 81 |
| TB-3 | OF | 32 | OC | 71 | RP-1 | 81 |
| TB-4 | OD | 66 | OA | 108 | RP-1 | 81 |
| TB-5 | OE | 36 | OC | 71 | RP-2 | 35 |
| TB-6 | OE | 36 | OC | 71 | — | — |

<Measurement of Coverage Ratio>

The first shell layer coverage ratio and the second shell layer coverage ratio of the toners TA-1 to TA-7 were measured according to a method described below. With respect to each of the toners TA-1 to TA-7, a sample (the toner) was dispersed in a visible light curing resin ("ARONIX (registered Japanese trademark) D-800", product of Toagosei Co., Ltd.), and then the resin was caused to cure through visible light irradiation to obtain a hardened material. Thereafter, the hardened material was cut at a cutting rate of 0.3 mm/second using an ultrathin piece forming knife ("SUMI KNIFE (registered Japanese trademark)", product of Sumitomo Electric Industries, Ltd., a diamond knife having a blade width of 2 mm and a blade tip angle of 45°) and an ultramicrotome ("EM UC6", product of Leica Microsystems) to form a flake sample having a thickness of 150 nm. The thus obtained flake sample was dyed in ruthenium through exposure to vapor of an aqueous ruthenium tetroxide solution on a copper mesh for 10 minutes. Subsequently, an image of a cross-section of the dyed flake sample was captured using a transmission electron microscope (TEM) ("H-7100FA", product of Hitachi High-Technologies Corporation.).

The thus obtained TEM image (images of cross-sections of the toner particles) was analyzed using image analysis software ("WinROOF", product of Mitani Corporation). Specifically, in a TEM image of a toner particle, the first shell layer coverage ratio was determined by measuring a percentage of an area covered with the first shell layer out of the surface area of the toner core (an area defined by an outline representing a periphery of the toner core). The first shell layer coverage ratio was measured with respect to 10 toner particles included in the sample (the toner), and the arithmetic mean of the 10 measured values was determined to be an evaluation value (the first shell layer coverage ratio) of the sample (the toner). Likewise, in a TEM image of a toner particle, the second shell layer coverage ratio was determined by measuring a percentage of an area covered with the second shell layer out of the surface area of the first shell layer (an area defined by an outline representing a periphery of the first shell layer). The second shell layer coverage ratio was measured with respect to 10 toner particles included in the sample (the toner), and the arithmetic mean of the 10 measured values was determined to be an evaluation value (the second shell layer coverage ratio) of the sample (the toner).

The toners TA-1 to TA-7 each had a first shell layer coverage ratio of at least 90% and no greater than 100%. The toners TA-1 to TA-7 each had a second shell layer coverage ratio of at least 30% and no greater than 70%.

<Measurement of Terephthalic Acid Content>

Figure 2:
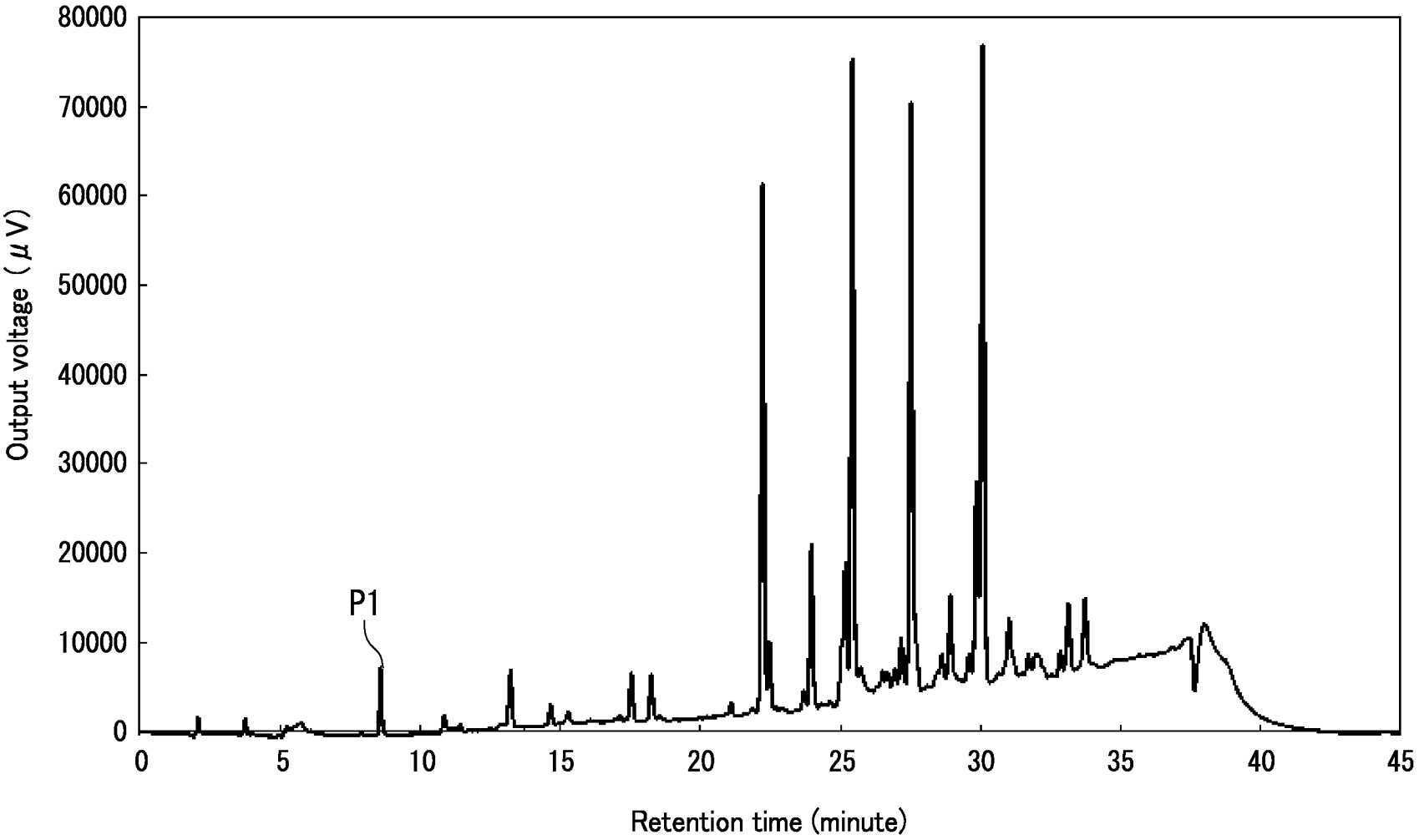
FIG. 2 is a chart showing an example of a result of analysis of the toner according to Example by high-performance liquid chromatography.

With respect to each of the toners TA-1 to TA-7 and TB-1 to TB-6, 2 g of the toner as an evaluation target and 50 g of distilled water at 50° C. were added into a 100-mL sample tube, and then the sample tube contents were mixed for 30 minutes under stirring at a rotational speed of 800 rpm using a stirrer. The mixing was performed while the temperature of the sample tube contents was kept at 50° C. Next, the sample tube contents were cooled to 30° C. Next, the sample tube contents were centrifuged at a rotational speed of 9,000 rpm for 15 minutes using a centrifuge adhesion measuring device ("NS-C100", product of Nano Seeds Corporation). Supernatant was collected through the centrifugation and filtered using a filter having a pore size of 0.45 μm. The resultant filtrate was used as a sample and analyzed by HPLC. Specifically, the sample was analyzed using the following analyzer under the following analysis conditions to obtain an HPLC chart. FIG. 2 shows an example of the HPLC chart. FIG. 2 shows a chart indicating a result of the analysis of the toner TA-1 by HPLC. Note that "output voltage" represented by the vertical axis in FIG. 2 indicates voltage output by a detector in an HPLC device used for the analysis.

[Analyzer]

An HPLC device ("LC-2010A HT", product of Shimadzu Corporation) was used as an analyzer. An HPLC column ("SHIM-PACK GWS C18", product of Shimadzu Corporation) was used.

[Analysis Conditions]

Measurement wavelength: 207 nm

Column temperature: 40° C.

Sample injection amount: 10 μL

Liquid A: aqueous phosphoric acid solution (concentration: 0.1% by mass)

Liquid B: acetonitrile

Total flow rate of liquids A and B: 1.0 mL/minute

Concentration gradient: as specified in Table 2

TABLE 2

| Time [minutes] | Liquid A | Liquid B |
|---|---|---|
| 0-35.00 | Decrease from 100% by volume to 20% by volume | Increase from 0% by volume to 80% by volume |
| 35.01-44.99 | 100% by volume | 0% by volume |
| 45.00 | 0% by volume | 0% by volume |

The amount of terephthalic acid contained in the sample (the terephthalic acid content) was determined from a peak area of a peak P1 (see FIG. 2) between a retention time of 8 minutes and a retention time of 9 minutes on the HPLC chart. Note that the terephthalic acid content was determined using a calibration curve based on standard substances. A peak P1 fraction of the HPLC chart shown in FIG. 2 was separated and subjected to qualitative analysis by gas chromatography-mass spectrometry (GC/MS) to confirm that the peak P1 fraction was terephthalic acid.

<Evaluation of Low-Temperature Fixability>

[Preparation of Two-Component Developer]

With respect to each of the toners TA-1 to TA-7 and TB-1 to TB-6, 8 parts by mass of the toner for evaluation and 100 parts by mass of a carrier (a carrier produced by Powdertech Co., Ltd., volume median diameter ($D_{50}$): 35 μm, volume resistivity: $1.0\times10^7$ Ω·cm, saturation magnetization in an applied magnetic field of 3,000 ($10^3/4\pi\cdot A/m$): 70 $Am^2/kg$) for "TASKalfa8052ci", product of KYOCERA Document Solutions Inc., were mixed for 30 minutes using a shaker mixer ("TURBULA (registered Japanese trademark) MIXER T2F", product of Willy A. Bachofen AG) to prepare a two-component developer for evaluation.

[Measurement of Minimum Fixable Temperature]

A multifunction peripheral (an evaluation apparatus obtained by modifying "TASKalfa8052ci", product of KYOCERA Document Solutions Inc., to enable adjustment of fixing temperature) was used for evaluation. The two-component developer prepared as described above was loaded into a cyan-color developing device of the evaluation apparatus, and toner for replenishment use (the toner being evaluated) was loaded into a cyan-color toner container of the evaluation apparatus.

A solid image (specifically, an unfixed toner image) having a size of 25 mm×25 mm was formed on evaluation paper ("COLORCOPY (registered Japanese trademark)", product of Mondi, A4 size, basis weight: 90 $g/m^2$) using the evaluation apparatus at a toner application amount of 1.0 $mg/cm^2$ under environmental conditions of a temperature of 23° C. and a relative humidity of 50%. Subsequently, the evaluation paper with the image formed thereon was passed through a fixing device of the evaluation apparatus. The lowest temperature at which the solid image (the toner image) was fixable to the evaluation paper (a minimum fixable temperature) was measured by increasing the fixing temperature of the fixing device from 100° C. in increments of 2° C. and determining whether or not the toner was fixable at each fixing temperature. Determination of whether or not the toner was fixable was carried out through a fold-rubbing test described below. Specifically, the evaluation paper passed through the fixing device was folded in half with a surface having the image formed thereon facing inward at a folding line crossing a center of the image, and a 1-kg brass weight covered with cloth was rubbed back and forth on the fold five times. Subsequently, the evaluation paper was opened up and a fold portion (a portion on which the solid image was formed) of the evaluation paper was observed. Then, the length of toner peeling of the fold portion (peeling length) was measured. The minimum fixable temperature was determined to be the lowest temperature among fixing temperatures for which the peeling length was no greater than 1 mm. The toner was evaluated as "having excellent low-temperature fixability" if the minimum fixable temperature thereof was no greater than 140° C., and as "having poor low-temperature fixability" if the minimum fixable temperature thereof was greater than 140° C.

<Evaluation of Heat-Resistant Preservability>

With respect to each of the toners TA-1 to TA-7 and TB-1 to TB-6, 2 g of the toner (the toner for evaluation) was added into a polyethylene vessel (capacity: 20 mL), and then the polyethylene vessel was sealed. Next, the sealed vessel was left to stand in a thermostatic chamber set at 58° C. for 3 hours. Thereafter, the toner was taken out of the vessel and cooled to room temperature (25° C.) to give an evaluation target.

The thus obtained evaluation target was placed on a 100-mesh sieve (pore size: 150 μm) of known mass. The mass of the toner before sifting was calculated by measuring the total mass of the sieve and the evaluation target thereon. Subsequently, the sieve was set in a powder property evaluation machine ("POWDER TESTER (registered Japanese trademark)" PT-X, product of Hosokawa Micron Corporation) and shaken for 30 seconds at an amplitude of 1.0 mm in accordance with a manual of the powder property evaluation machine to shift the evaluation target. After the sifting, the mass of toner that did not pass through the sieve was measured. An aggregation rate (unit: % by mass) was calculated in accordance with the following expression based on the mass of the toner before sifting and the mass of the toner after sifting. The toner was evaluated as "having particularly excellent heat-resistant preservability" if the aggregation rate was no greater than 10%. The toner was evaluated as "having excellent heat-resistant preservability" if the aggregation rate was greater than 10% by mass and no greater than 15% by mass. The toner was evaluated as "having poor heat-resistant preservability" if the aggregation rate was greater than 15% by mass. Note that the "mas of toner after sifting" in the following expression means the mass of toner that did not pass through the sieve, which in other words is the mass of toner remaining on the sieve after the sifting.

$$\text{Aggregation rate} = 100\times\frac{\text{mass of toner after sifting}}{\text{mass of toner before sifting}}$$

<Evaluation of Anti-Fogging Performance>

[Preparation of Two-Component Developer]

With respect to each of the toners TA-1 to TA-7 and TB-1 to TB-6, 7 parts by mass of the toner for evaluation and 100 parts by mass of a carrier (a carrier produced by Powdertech Co., Ltd., volume median diameter ($D_{50}$): 35 μm, volume resistivity: $1.0\times10^7$ Ω·cm, saturation magnetization in an applied magnetic field of 3,000 ($10^3/4\pi\cdot A/m$): 70 $Am^2/kg$) for "TASKalfa8052ci", product of KYOCERA Document Solutions Inc., were mixed for 30 minutes using a shaker mixer ("TURBULA (registered Japanese trademark) MIXER T2F", product of Willy A. Bachofen AG) to obtain a mixture. Furthermore, 1 part by mass of the toner for evaluation was added to 107 parts by mass of the resulting mixture to prepare a two-component developer for evaluation.

[Measurement of Fogging Density]

A multifunction peripheral ("TASKalfa8052ci", product of KYOCERA Document Solutions Inc.) was used as an evaluation apparatus. The two-component developer prepared as described above was loaded into a cyan-color developing device of the evaluation apparatus, and toner for replenishment use (the toner being evaluated) was loaded into a cyan-color toner container of the evaluation apparatus. A voltage between a development sleeve and a magnet roll of the evaluation apparatus was adjusted in a range of from 200 V to 300 V to give a solid image density of at least 1.0 and no greater than 1.2 as measured using a reflection densitometer (SPECTROEYE (registered Japanese trademark), product of X-Rite Inc.).

A solid image having a size of 20 mm×30 mm was printed on a sheet of printing paper (A4 size) using the evaluation apparatus under environmental conditions of a temperature of 23° C. and a relative humidity of 50%. Next, a reflection density of the blank portion of the printed paper was measured using a reflectance densitometer (SPECTROEYE (registered Japanese trademark), product of X-Rite Inc.). Then a fogging density (FD) was determined in accordance with the following expression. The toner was evaluated as "having excellent anti-fogging performance" if the fogging density was 0.005 or lower, and as "having poor anti-fogging performance" if the fogging density was higher than 0.005.

Fogging density=reflection density of blank portion−reflection density of unprinted paper Table 3 shows the terephthalic acid content, the minimum fixable temperature, the aggregation rate, and the fogging density with respect to each of the toners TA-1 to TA-7 and TB-1 to TB-6.

TABLE 3

| | Toner | Terephthalic acid content [mass ppm] | Minimum fixable temperature [° C.] | Aggregation rate [% by mass] | Fogging density |
|---|---|---|---|---|---|
| Example 1 | TA-1 | 47 | 128 | 8 | 0.001 |
| Example 2 | TA-2 | 48 | 132 | 7 | 0.002 |
| Example 3 | TA-3 | 33 | 134 | 3 | 0.004 |
| Example 4 | TA-4 | 35 | 132 | 3 | 0.002 |
| Example 5 | TA-5 | 93 | 128 | 9 | 0.002 |
| Example 6 | TA-6 | 55 | 128 | 8 | 0.002 |
| Example 7 | TA-7 | 109 | 126 | 15 | 0.002 |
| Comparative Example 1 | TB-1 | 66 | 124 | 18 | 0.002 |
| Comparative Example 2 | TB-2 | 55 | 142 | 1 | 0.004 |
| Comparative Example 3 | TB-3 | 90 | 124 | 23 | 0.001 |
| Comparative Example 4 | TB-4 | 34 | 144 | 1 | 0.005 |
| Comparative Example 5 | TB-5 | 98 | 122 | 18 | 0.001 |
| Comparative Example 6 | TB-6 | 61 | 126 | 8 | 0.006 |

As shown in Table 1, in the toner particles of each of the toners TA-1 to TA-7, the first thermoplastic resin had a Tg of at least 35° C. and no greater than 66° C. In the toner particles of each of the toners TA-1 to TA-7, the second thermoplastic resin had a Tg of at least 71° C. and no greater than 105° C. In the toner particles of each of the toners TA-1 to TA-7, the third thermoplastic resin (hydrophobic resin) had a higher Tg than the first thermoplastic resin.

As shown in Table 3, the toners TA-1 to TA-7 each had a minimum fixable temperature of no greater than 140° C. That is, the toners TA-1 to TA-7 had excellent low-temperature fixability. The toners TA-1 to TA-6 each resulted in an aggregation rate of no greater than 10% by mass. That is, the toners TA-1 to TA-6 had particularly excellent heat-resistant preservability. The toner TA-7 resulted in an aggregation rate of 15% by mass. That is, the toner TA-7 had excellent heat-resistant preservability. The toners TA-1 to TA-7 each resulted in a fogging density of no greater than 0.005. That is, the toners TA-1 to TA-7 had excellent anti-fogging performance.

As shown in Table 1, in the toner particles of the toner TB-1, the second thermoplastic resin had a Tg of less than 71° C. In the toner particles of the toner TB-2, the first thermoplastic resin had a Tg of greater than 66° C. In the toner particles of the toner TB-3, the first thermoplastic resin had a Tg of less than 35° C. In the toner particles of the toner TB-4, the second thermoplastic resin had a Tg of greater than 105° C. In the toner particles of the toner TB-5, the third thermoplastic resin (hydrophobic resin) had a lower Tg than the first thermoplastic resin. The toner particles of the toner TB-6 had no second shell layers.

As shown in Table 3, the toners TB-2 and TB-4 each had a minimum fixable temperature of greater than 140° C. That is, the toners TB-2 and TB-4 had poor low-temperature fixability. The toners TB-1, TB-3, and TB-5 each resulted in an aggregation rate of greater than 15% by mass. That is, the toners TB-1, TB-3, and TB-5 had poor heat-resistant preservability. The toner TB-6 resulted in a fogging density of greater than 0.005. That is, the toner TB-6 had poor anti-fogging performance.

These results indicate that the toners according to the present disclosure are excellent in low-temperature fixability, heat-resistant preservability, and anti-fogging performance.

What is claimed is:

1. A toner comprising toner particles, wherein the toner particles each include a toner core containing a binder resin, a first shell layer covering a surface of the toner core, and a second shell layer partially covering a surface of the first shell layer, the first shell layers include first domains composed of a first thermoplastic resin and second domains composed of a second thermoplastic resin, the first thermoplastic resin has a glass transition point of at least 35° C. and no greater than 66° C., the second thermoplastic resin has a glass transition point of at least 71° C. and no greater than 105° C., the second shell layers contain a third thermoplastic resin that is more hydrophobic than the first thermoplastic resin and the second thermoplastic resin, and the third thermoplastic resin has a higher glass transition point than the first thermoplastic resin.

2. The toner according to claim 1, wherein the glass transition point of the third thermoplastic resin is at least 10° C. higher than the glass transition point of the first thermoplastic resin.

3. The toner according to claim 1, wherein the glass transition point of the third thermoplastic resin is at least 45° C. and no greater than 100° C.

4. The toner according to claim 1, wherein the binder resin includes a polyester resin, and the first thermoplastic resin and the second thermoplastic resin are each a polymer of one or more monomers including at least a compound represented by formula (1) shown below, (1)

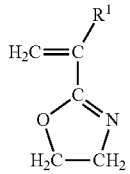

where in formula (1), $R^1$ represents a hydrogen atom or an alkyl group optionally substituted with a phenyl group.

5. The toner according to claim 4, wherein the polyester resin includes a repeating unit derived from terephthalic acid, and an amount of terephthalic acid contained in supernatant obtained by mixing 2 g of the toner and 50 g of distilled water at a temperature of 50° C. under stirring and centrifuging a resultant mixture is no greater than 100 mass ppm.

6. The toner according to claim 1, wherein the third thermoplastic resin is a copolymer of styrene and at least one alkyl (meth)acrylate.

* * * * *